US008899211B2

(12) United States Patent
Aso et al.

(10) Patent No.: US 8,899,211 B2
(45) Date of Patent: Dec. 2, 2014

(54) CONTROLLING CYLINDERS BASED ON INTAKE VACUUM DURING ENGINE START

(75) Inventors: Koji Aso, Susono (JP); Hiroshi Tanaka, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 222 days.

(21) Appl. No.: 13/026,378

(22) Filed: Feb. 14, 2011

(65) Prior Publication Data

US 2011/0197860 A1 Aug. 18, 2011

(30) Foreign Application Priority Data

Feb. 12, 2010 (JP) ..... 2010-028901

(51) Int. Cl.

| | |
|---|---|
| ***F02B 1/00*** | (2006.01) |
| ***F02D 41/06*** | (2006.01) |
| ***F02D 41/04*** | (2006.01) |
| *F02D 41/00* | (2006.01) |

(52) U.S. Cl.

CPC ..... *F02D 41/047* (2013.01); *F02D 2200/0406* (2013.01); *F02D 41/064* (2013.01); *F02D 2250/41* (2013.01); *F02D 41/0087* (2013.01)

USPC ..... 123/491; 123/179.16; 123/179.18

(58) Field of Classification Search

USPC ..... 123/179.16, 179.18, 179.3, 179.1, 481, 123/491, 325, 332, 198 F, 366, 406.53, 685; 701/112, 113, 102, 104, 110

See application file for complete search history.

(56) References Cited

U.S. PATENT DOCUMENTS

| | | | | |
|---|---|---|---|---|
| 3,918,417 | A * | 11/1975 | Gambill et al. | 123/485 |
| 5,444,306 | A * | 8/1995 | Sawa et al. | 307/9.1 |
| 5,690,073 | A | 11/1997 | Fuwa | |
| 5,800,793 | A * | 9/1998 | Cole | 423/213.2 |
| 5,826,564 | A | 10/1998 | Fuwa et al. | |
| 7,082,930 | B2 * | 8/2006 | Liller et al. | 123/491 |
| 7,093,426 | B2 * | 8/2006 | Ichihara et al. | 60/285 |
| 7,472,692 | B2 | 1/2009 | Nakagawa et al. | |
| 8,272,358 | B2 * | 9/2012 | Yoshioka | 123/90.17 |
| 8,353,266 | B2 * | 1/2013 | White et al. | 123/179.3 |
| 2006/0254564 | A1 * | 11/2006 | Lewis et al. | 123/491 |

FOREIGN PATENT DOCUMENTS

| | | | |
|---|---|---|---|
| JP | 08105336 | A | 4/1996 |
| JP | 08326584 | A | 12/1996 |
| JP | 08338282 | A | 12/1996 |
| JP | 09324678 | A | 12/1997 |
| JP | 10103097 | A | 4/1998 |
| JP | 2000179367 | A | 6/2000 |
| JP | 2001159328 | A | 6/2001 |
| JP | 2005009403 | A | 1/2005 |
| JP | 2007198176 | A | 8/2007 |
| JP | 2009085123 | A | 4/2009 |

* cited by examiner

*Primary Examiner* — Stephen K Cronin
*Assistant Examiner* — Gonzalo Laguarda
(74) *Attorney, Agent, or Firm* — Gifford, Krass, Sprinkle, Anderson & Citkowski, P.C.

(57) ABSTRACT

An internal combustion engine is started by performing fuel supply into part of a plurality of cylinders included in the internal combustion engine. After the magnitude of the negative pressure produced in intake piping of the internal combustion engine exceeds a predetermined reference value, fuel supply into the remaining cylinder(s) is started.

17 Claims, 21 Drawing Sheets

| CYLINDER NUMBER ASSIGNED IN VIEW OF FIRING ORDER | #1 | #2 | #3 | #4 | #5 | #6 | #7 | #8 | STOP CYLINDER NUMBER |
|---|---|---|---|---|---|---|---|---|---|
| PARTIAL-CYLINDER OPERATION | ○ | × | ○ | × | ○ | × | ○ | × | 4 |
| FIRST CYCLE | ○ | ○ | ○ | × | ○ | × | ○ | × | 3 |
| SECOND CYCLE | ○ | ○ | ○ | ○ | ○ | × | ○ | × | 2 |
| THIRD CYCLE (RETARDATION CYCLE NUMBER IS CHANGED) | ○ | ○ | ○ | ○ | ○ | × | ○ | × | 2 |
| FOURTH CYCLE (RETARDATION CYCLE NUMBER IS CHANGED) | ○ | ○ | ○ | ○ | ○ | ○ | ○ | × | 1 |
| FIFTH CYCLE (RETARDATION CYCLE NUMBER IS CHANGED) | ○ | ○ | ○ | ○ | ○ | ○ | ○ | × | 1 |
| SIXTH CYCLE (ALL-CYLINDER OPERATION) | ○ | ○ | ○ | ○ | ○ | ○ | ○ | ○ | 0 |

FIG. 12

| CYLINDER NUMBER ASSIGNED IN VIEW OF FIRING ORDER | #1 | #2 | #3 | #4 | #5 | #6 | #7 | #8 | STOP CYLINDER NUMBER |
|---|---|---|---|---|---|---|---|---|---|
| PARTIAL-CYLINDER OPERATION | ○ | × | ○ | × | ○ | × | ○ | × | 4 |
| FIRST CYCLE | ○ | ○ | ○ | × | ○ | × | ○ | × | 3 |
| SECOND CYCLE | ○ | ○ | ○ | ○ | ○ | × | ○ | × | 2 |
| THIRD CYCLE | ○ | ○ | ○ | ○ | ○ | ○ | ○ | × | 1 |
| FOURTH CYCLE (ALL-CYLINDER OPERATION) | ○ | ○ | ○ | ○ | ○ | ○ | ○ | ○ | 0 |

FIG. 13

| CYLINDER NUMBER ASSIGNED IN VIEW OF FIRING ORDER | #1 | #2 | #3 | #4 | #5 | #6 | #7 | #8 | STOP CYLINDER NUMBER |
|---|---|---|---|---|---|---|---|---|---|
| PARTIAL-CYLINDER OPERATION | ○ | × | ○ | × | ○ | × | ○ | × | 4 |
| FIRST CYCLE | ○ | ○ | ○ | × | ○ | × | ○ | × | 3 |
| SECOND CYCLE | ○ | ○ | ○ | ○ | ○ | × | ○ | × | 2 |
| THIRD CYCLE (RETARDATION CYCLE NUMBER IS CHANGED) | ○ | ○ | ○ | ○ | ○ | × | ○ | × | 2 |
| FOURTH CYCLE (RETARDATION CYCLE NUMBER IS CHANGED) | ○ | ○ | ○ | ○ | ○ | ○ | ○ | × | 1 |
| FIFTH CYCLE (RETARDATION CYCLE NUMBER IS CHANGED) | ○ | ○ | ○ | ○ | ○ | ○ | ○ | × | 1 |
| SIXTH CYCLE (ALL-CYLINDER OPERATION) | ○ | ○ | ○ | ○ | ○ | ○ | ○ | ○ | 0 |

○ : FIRING × : STOP △ : LEAN BURN

| CYLINDER NUMBER ASSIGNED IN VIEW OF FIRING ORDER | #1 | #2 | #3 | #4 | #5 | #6 | #7 | #8 | STOP CYLINDER NUMBER |
|---|---|---|---|---|---|---|---|---|---|
| PARTIAL-CYLINDER OPERATION | ○ | × | ○ | × | ○ | × | ○ | × | 4 |
| FIRST CYCLE | △ | ○ | ○ | × | ○ | × | ○ | × | 3 |
| SECOND CYCLE | △ | ○ | △ | ○ | ○ | × | ○ | × | 2 |
| THIRD CYCLE | △ | ○ | △ | ○ | △ | ○ | ○ | × | 1 |
| FOURTH CYCLE (ALL-CYLINDER OPERATION) | △ | ○ | △ | ○ | △ | ○ | △ | ○ | 0 |

CYLINDER IDENTIFICATION

| CCRNK | RETARDED START CYLINDERS |
|---|---|
| 1 | 1865 |
| 5 | 8754 |
| 8 | 7365 |
| 11 | 3621 |
| 13 | 6518 |
| 17 | 5487 |
| 20 | 4273 |
| 23 | 2136 |

| | FIRING CYLINDER : ○ STOP CYLINDER : × | | | | | | | | STOP CYLINDER NUMBER |
|---|---|---|---|---|---|---|---|---|---|
| pm DIFFERENCE | #1 | #2 | #3 | #4 | #5 | #6 | #7 | #8 | |
| 0 | ○ | × | ○ | × | ○ | × | ○ | × | 4 |
| 15 | ○ | ○ | ○ | × | ○ | × | ○ | × | 3 |
| 30 | ○ | ○ | ○ | ○ | ○ | × | ○ | × | 2 |
| 45 | ○ | ○ | ○ | ○ | ○ | ○ | ○ | × | 1 |
| 60 | ○ | ○ | ○ | ○ | ○ | ○ | ○ | ○ | 0 |

CONTROLLING CYLINDERS BASED ON INTAKE VACUUM DURING ENGINE START

CROSS-REFERENCE TO RELATED APPLICATIONS

This application claims priority to Japanese Patent Application No. 2010-028901 filed on Feb. 12, 2010, which is incorporated herein by reference in its entirety including the specification, drawings and abstract.

BACKGROUND OF THE INVENTION

1. Field of the Invention

The invention relates to an internal combustion engine controller and in particular to a controller for a multi-cylinder internal combustion engine.

2. Description of the Related Art

In an internal combustion engine, fuel injected from a fuel injection valve into an intake port is partially vaporized and the remaining fuel attaches to the wall surface of the intake port. The fuel that attaches to the intake port wall surface is vaporized by the negative pressure in intake piping and the heat supplied from the intake port wall surface and forms a mixture together with the vaporized part of the fuel subsequently injected from the fuel injection valve. During steady operation, the amount of fuel that is injected from the fuel injection valve and attaches to the wall surface of the intake port and the amount of vaporization of the fuel that has attached to the wall surface of the intake port balance. Thus, it is possible to make the air-fuel ratio of the mixture formed in the cylinder the stoichiometric air-fuel ratio by injecting fuel, the amount of which corresponds to the stoichiometric air-fuel ratio, from the fuel injection valve.

However, when the internal combustion engine is started, especially when the engine is cold-started, the temperature in the intake piping and the temperature of the wall surface of the intake port are low and the negative pressure in the intake piping is not produced yet. In addition, the amount of fuel that has attached to the intake port since before the engine is started is not large. Thus, most of the fuel injected from the fuel injection valve at the time of starting the engine attaches to the wall surface of the intake port. For this reason, in order to form the mixture with an ignitable concentration in the cylinder, at least in the first cycle at the time of starting the engine, it is necessary to supply a larger amount of fuel than is supplied during steady operation after warm-up is completed. In addition, because fuel supply is performed for each cylinder, in the case of a multi-cylinder internal combustion engine with multiple cylinders, a large amount of fuel is supplied to the cylinders sequentially. However, when a large amount of fuel is supplied, a correspondingly large amount of unburned HC is discharged from the cylinders into the exhaust passage. Although the catalyst for purifying the exhaust gas is disposed in the exhaust passage, it takes a certain period of time for the purification ability of the catalyst to be activated during start-up when the temperature of the catalyst is low. Thus, it is desired to minimize the discharge of unburned HC from the cylinders at least until the catalyst is activated. Reduction of unburned HC produced at the time of start-up is regarded as one of the important issues related to the automobile having an internal combustion engine as the power source.

As solutions for the above issue, various technologies have been proposed. One of such proposals is a technology (hereinafter referred to as the related art) related to fuel supply at the time of starting a multi-cylinder internal combustion engine described in Japanese Patent Application Publication No. H08-338282 (JP-A-H08-338282). As described in JP-A-H08-338282, there is no need to supply a large amount of fuel into the cylinders consecutively in order to start a multi-cylinder internal combustion engine. It is possible to start an internal combustion engine even if fuel supply into part of the cylinders is stopped. When the engine is started with the fuel supply into part of the cylinders stopped, it is possible to significantly reduce the unburned HC discharged during start-up. The above related art is an invention made based on such knowledge. In this related art, the cylinder(s), to which fuel supply is performed, and the cylinder(s), to which fuel supply is stopped, are determined based on the result of identification of the cylinders during start-up and fuel supply into the cylinders is controlled according to the result of the determination. More specifically, in the above related art, the pattern of fuel supply into the cylinders is determined based on the water temperature at the time of start-up. A plurality of patterns of fuel supply that differ from each other depending on the water temperature, are prepared. In the patterns corresponding to high water temperatures, the number of cylinders, into which fuel supply is stopped, is set to a larger number and in the patterns corresponding to low water temperatures, the number of cylinders, into which fuel supply is stopped, is set to a smaller number. In all of these patterns, fuel supply into the cylinder, the timing of fuel supply into which comes first during start-up, is always performed. Moreover, regardless of which pattern is selected, the cycle, in which fuel supply is stopped, is the first cycle during start-up, and fuel supply is performed for all the cylinders in and after the second cycle if the start-up is completed.

In the above related art, into the cylinder(s), into which fuel supply is performed from the beginning of start-up, a large amount of fuel is supplied during the first fuel supply (the amount of fuel supplied during the first fuel supply is referred to as the start-up fuel supply amount, Qs). On the other hand, when the fuel supply into the cylinder(s), into which fuel supply has been stopped, is started, the amount of fuel supply into the cylinder(s) is not the start-up fuel supply amount Qs but the amount obtained by multiplying, by an increasing rate KK (>1.0), a post-start fuel supply amount, Qt, that is smaller than the start-up fuel supply amount Qs. As a result, the amount of the initial fuel supply into the cylinders, into which fuel supply is retarded (hereinafter referred to as the retarded start cylinder), is reduced as compared to that of the cylinder(s), into which fuel supply is performed from the beginning.

The amount of the initial fuel supply into the retarded start cylinder(s) can be reduced because of the following two operations caused by the retardation of the fuel supply. The first operation is the increase in the temperature in the cylinder(s) caused by the ineffective compression that occurs in the retarded start cylinder(s) and is accompanied by no combustion. The second operation is the occurrence of the negative pressure in the intake piping that accompanies the increase in the rotational speed of the internal combustion engine while fuel supply is retarded. Of these two operations, the latter, that is, the occurrence of the negative pressure in the intake piping particularly contributes to the reduction of the amount of fuel supply. When the intake piping negative pressure occurs, the atmosphere such that vaporization of the fuel is promoted in the retarded start cylinder(s) as compared to the cylinders, into which fuel supply is performed from the beginning, is created by the occurrence of the intake piping negative pressure. When vaporization of fuel is promoted, the amount of initial fuel supply into the retarded start cylinder(s) may be correspondingly reduced.

In the above related art, however, whether the start up has been completed is determined based on the rotational speed of the internal combustion engine and when it is determined that the start up has been completed in the first cycle during start up, fuel supply is sequentially performed into all the cylinders from the second cycle. However, the magnitude of the negative pressure produced in the intake piping depends not only on the rotational speed and therefore, a negative pressure enough to promote vaporization of fuel is not always produced in the intake piping when fuel supply into the retarded start cylinder(s) is started. It is considered that, in order to avoid misfiring caused by lack of fuel, it is difficult to significantly reduce the amount of initial fuel supply into the retarded start cylinder(s) as compared to the amount of initial fuel supply into the cylinder(s), into which fuel is supplied from the beginning.

As described above, in view of the reduction of unburned HC produced when the internal combustion engine is started, there is a room for improvement in the above related art.

SUMMARY OF THE INVENTION

The invention provides a controller, with which it is possible to suppress discharge of unburned HC when an internal combustion engine is started.

An internal combustion engine controller according to a first aspect of the invention includes: a starting section that starts an internal combustion engine by performing fuel supply into part of a plurality of cylinders included in the internal combustion engine; and a fuel supply starting section that starts fuel supply into at least one remaining cylinder of the plurality of cylinders after the magnitude of a negative pressure produced in intake piping of the internal combustion engine exceeds a predetermined reference value.

According to the internal combustion engine controller of the first aspect, the internal combustion engine is started by performing fuel supply into part of the plurality of cylinders, so that it is possible to reduce the total amount of fuel supply required to start the internal combustion engine as compared to the case where the internal combustion engine is started by performing fuel supply into all the cylinders. In addition, fuel supply into the remaining cylinder(s) is started after the magnitude of the negative pressure produced in the intake piping exceeds the predetermined reference value, so that vaporization of the fuel of the initial supply into the remaining cylinder(s) is promoted by the negative pressure. Thus, it is possible to significantly reduce the amount of initial fuel supply into the retarded start cylinder(s) as compared to that of the cylinder(s), into which fuel supply is performed from the beginning. Thus, according to the internal combustion engine controller of the first aspect, it is possible to reduce the total amount of fuel supply from when the engine is started until the engine reaches the normal operation and therefore, it is possible to suppress discharge of unburned HC from the internal combustion engine body to the exhaust passage.

A second aspect of the invention is an internal combustion engine control method that includes: starting an internal combustion engine by performing fuel supply into part of a plurality of cylinders included in the internal combustion engine; and starting fuel supply into at least one remaining cylinder of the plurality of cylinders after the magnitude of a negative pressure produced in intake piping of the internal combustion engine exceeds a predetermined reference value. Also with the internal combustion engine control method according to the second aspect of the invention, the effects similar to those achieved by the internal combustion engine controller according to the first aspect of the invention are achieved.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 12 is a diagram showing a basic setting pattern of retarded start cycle numbers of the respective cylinders, which is used in a controller of an eighth embodiment of the invention;

FIG. 13 is a diagram showing a changed setting pattern of the retarded start cycle numbers of the respective cylinders, which is used in the controller of the eighth embodiment of the invention;

DETAILED DESCRIPTION OF EMBODIMENTS

First Embodiment

A first embodiment of the invention will be described with reference to FIGS. 1 to 3.

Figure 1:
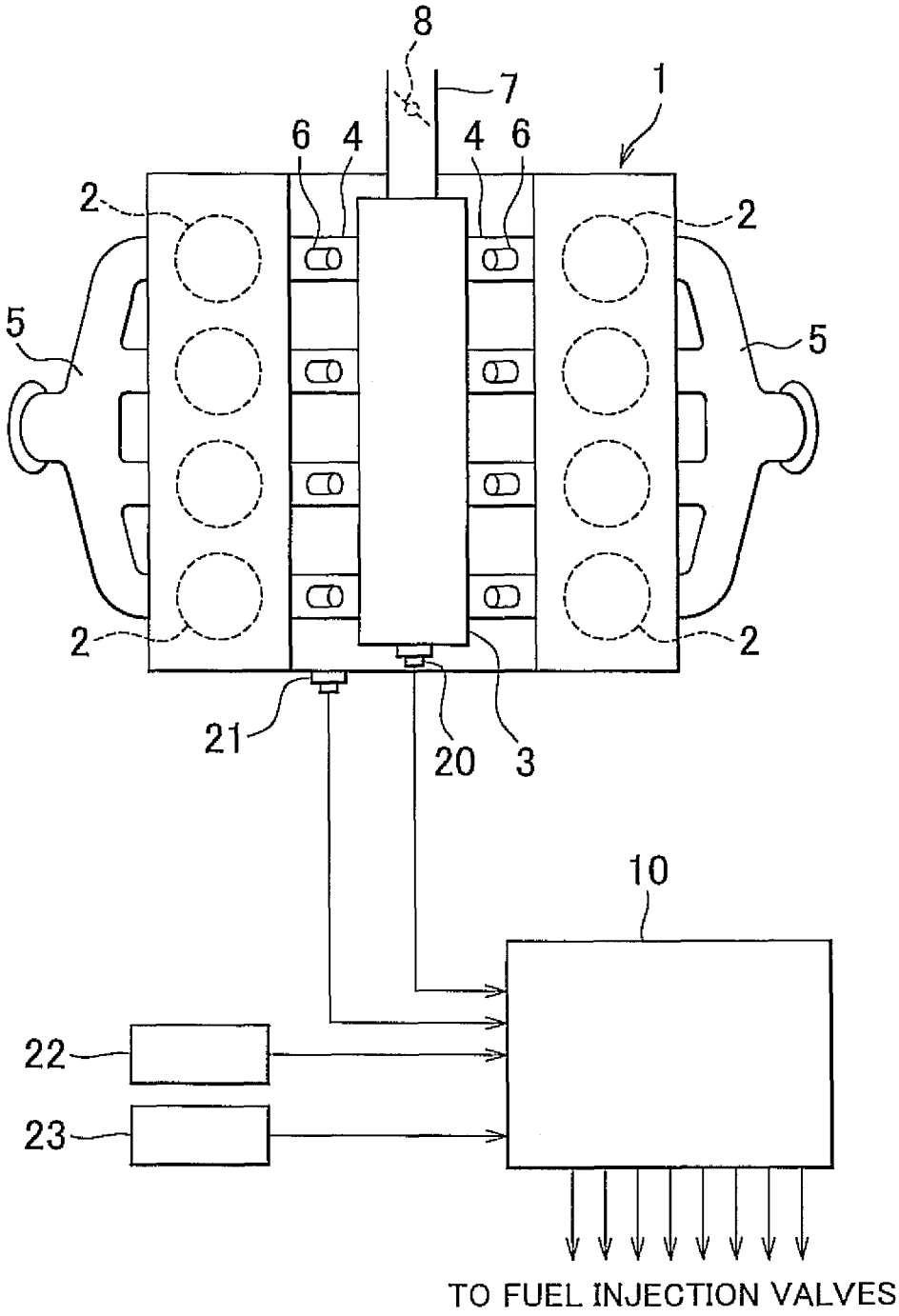
FIG. 1 is a diagram showing a configuration of a multi-cylinder internal combustion engine, in which a controller of a first embodiment of the invention is used.

FIG. 1 is a diagram showing a configuration of a multi-cylinder internal combustion engine (hereinafter referred to simply as the "engine"), in which a controller of the first embodiment is used. The engine 1 shown in FIG. 1 is a V-type 8-cylinder 4-stroke reciprocating engine having eight cylinders 2. The engine 1 is a spark-ignited engine provided with a spark plug (not shown) for each cylinder 2. The cylinders 2 and a surge tank 3 are connected to each other via intake branch pipes 4. The surge tank 3 and the intake branch pipes 4 are collectively referred to as intake piping. Each of the intake branch pipes 4 is provided with a fuel injection valve 6. Fuel is injected into an intake port of the corresponding cylinder 2 by each of the fuel injection valves 6. The surge tank 3 is connected to an air cleaner (not shown) via an intake duct 7 and a throttle valve 8 is disposed in the intake duct 7. On the other hand, an exhaust manifold 5 is provided for each bank on the exhaust side of the engine 1. An exhaust passage (not shown) is connected to each of the exhaust manifold 5 and a catalyst (not shown) for purifying the exhaust gas is disposed in the exhaust passage.

The engine 1 is provided with various sensors. For example, an intake piping pressure sensor 20 is provided that generates an output voltage according to the pressure in the surge tank 3 (intake piping pressure). The engine 1 is also provided with a water temperature sensor 21 that generates an output voltage according to the coolant temperature in the engine 1, a crank angle sensor 22 that generates an output pulse every time a crank shaft rotates a predetermined angle, and a cylinder identification sensor 23 that determines which cylinder is at the intake top dead center (TDC). The engine 1 is also provided with an electronic control unit 10. The electronic control unit 10 processes the signals from the above various sensors and reflects the result of processing on the operation of various actuators including the fuel injection valves 6.

The controller of the first embodiment is implemented as part of functions of the electronic control unit 10. Control of start-up of the engine 1 is performed by the electronic control unit 10, which functions as the controller. In the start-up control, the electronic control unit 10 does not supply fuel to all the cylinders but allows fuel to be injected to part of the cylinders from the fuel injection valves 6 to start the engine 1. After completion of start-up of the engine 1, fuel injection to the remaining cylinders is started when the conditions described later are satisfied. The start-up control, in which the engine 1 is started by injecting fuel into part of the cylinders, is herein referred to as retardative start control of the engine 1. In addition, in this specification, the cylinder, in which fuel injection is started from the first cycle during the start-up, is herein referred to as the normal start cylinder, and the cylinder, in which fuel injection is started from the second cycle or a later cycle after the normal start cylinder(s) is/are started, is referred to as the retarded start cylinder. The number of cylinder(s) that is/are set as the retarded start cylinder(s), out of the eight cylinders of the engine 1, may be arbitrarily set as long as the engine can be started. For example, half of the cylinders, that is, four cylinders, may be set as the retarded start cylinders. The cylinder(s) set as the retarded start cylinder(s) is/are not fixed but newly set every time according to the result of determination of the cylinders.

Figure 2:
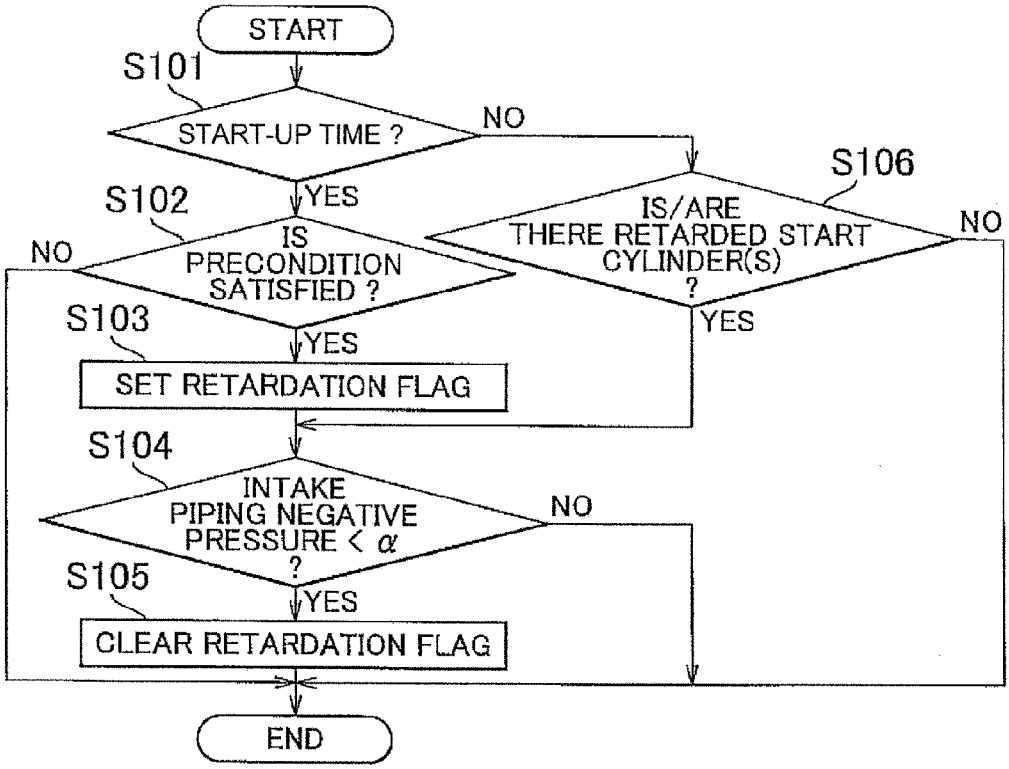
FIG. 2 is a flow chart showing a procedure of retardative start control that is performed by the controller of the first embodiment.
Figure 3:
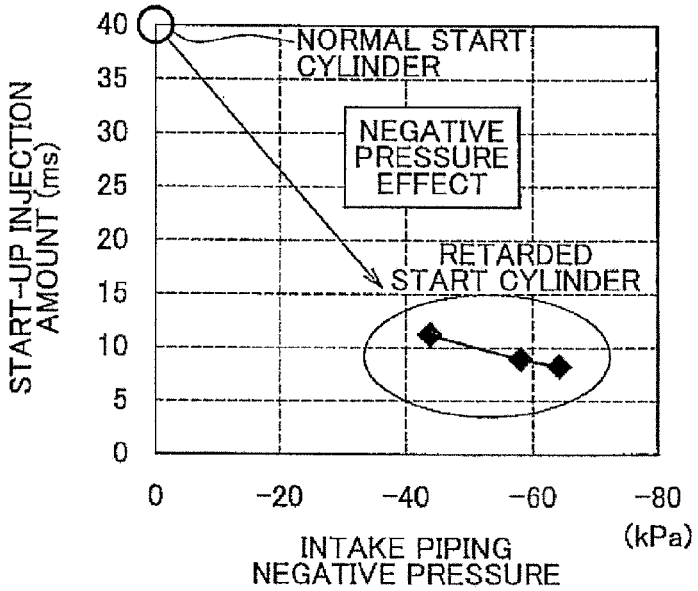
FIG. 3 is a diagram showing a relationship between the magnitude of the intake piping negative pressure and the fuel injection amount required to form an ignitable mixture.

FIG. 2 is a flow chart showing a procedure of the retardative start control of the engine 1 that is performed by the electronic control unit 10 of the first embodiment. In step S101, which is the first step of the retardative start control, it is determined whether the current time is in the "start-up time". The "start-up time" is herein defined as a time period from when cranking is started to when the start-up is completed. Ordinarily, whether start-up of the engine 1 has been completed is determined based on whether self-sustaining operation of the engine 1 has been started, more specifically, whether the engine speed has reached around 400 rpm. However, in the invention, the criteria for determining whether the startup has been completed differs depending on whether a retardation flag to be described later is on or off. In the case where the retardation flag is off, that is, in the case where no retarded start cylinder is set, when the engine speed exceeds 400 rpm as in the ordinary case, it is determined that start-up of the engine 1 has been completed. On the other hand, in the case where the retardation flag is on, that is, in the case where the retarded start cylinder(s) is/are set, when the engine speed exceeds 400 rpm and the first injection has been completed in every normal start cylinder (cylinder without retardation), it is determined that the start-up of the engine 1 has been completed.

When it is determined in step S101 that the current time is in the "start-up time", the determination of step S102 is performed. What is determined in step S102 is whether the precondition for setting the retarded start cylinder(s) is satisfied. The precondition is that the torque required to start the engine 1 can be obtained even when the retarded start cylinder(s) is/are set. In the case of multi-cylinder engines, such as V-type 8-cylinder engines, ordinarily, it is possible to start the engine with the fuel injection in part of the cylinders, that is, for example, half of the cylinders, stopped. However, when the water temperature is very low, combustion in the cylinders can be unstable and the torque produced per cylinder can be reduced, which can result in the failure in starting the engine 1 when the retarded start cylinder(s) is/are set. The precondition in step S102 is set to avoid such an event, and it is determined whether the precondition is satisfied, based on information on the conditions, such as water temperature and ambient temperature.

The result of determination in step S102 is reflected on the setting of the retardation flag described above. The initial setting of the retardation flag is off. When the result of determination in step S102 is No, the retardation flag remains off. In this case, the processes of steps S103, S104, and S105 are skipped. When the result of determination in step S102 is Yes, the process proceeds to step S103 and the retardation flag is set to on.

In the next step S104, it is determined whether the intake piping negative pressure falls below a predetermined reference value $\alpha$, that is, whether the magnitude of the intake piping negative pressure exceeds the predetermined reference value $\alpha$. When the engine 1 is started by the fuel injection into the normal start cylinders, the magnitude of the intake piping negative pressure in the engine 1 gradually increases as the engine speed increases. The intake piping negative pressure contributes to vaporization of fuel in the intake port. The higher the magnitude of the intake piping negative pressure becomes, the more the vaporization of fuel in the intake port is promoted. Because the fuel supply to the retarded start cylinder(s) is started under such a condition, which is advantageous to the vaporization of fuel, the amount of initial injection of fuel into the retarded start cylinder(s) may be reduced as compared to that of the normal start cylinder. However, this applies only when a sufficiently high magnitude of intake piping negative pressure is occurring. When the fuel injection into the retarded start cylinder(s) is started under low intake piping negative pressure conditions, sufficient reduction in the fuel injection amount effected by the promotion of vaporization cannot be achieved. FIG. 3 is a diagram showing the relationship between the magnitude of the intake piping negative pressure and the fuel injection amount required to form an ignitable mixture. As shown in FIG. 3, in the normal start cylinder, in which fuel is injected when the intake piping negative pressure is substantially zero, the amount of first injection of fuel (the amount of first injection of fuel into the normal start cylinder(s) will be hereinafter referred to as the "start-up injection amount," which is a fixed value or a value set based on the water temperature) is large. On the other hand, in the retarded start cylinder(s), when the fuel injection is started after the magnitude of the intake piping negative pressure becomes sufficiently high, it is possible to significantly reduce the amount of initial injection of fuel as compared to that of the normal start cylinder(s). The reference value $\alpha$ is a threshold value set in view of such a fact and until the magnitude of the intake piping negative pressure exceeds the reference value $\alpha$, fuel injection into the retarded start cylinder(s) continues to be stopped.

In actuality, the magnitude of the intake piping negative pressure exceeds the reference value $\alpha$ when start-up of the engine 1 has been completed, that is, after the engine speed exceeds 400 rpm and the initial injection has been completed in all the normal start cylinder(s). In this case, the result of determination in step S101 is No, and the determination in step S106 is then performed. In step S106, it is determined based on the retardation flag whether there is/are the retarded start cylinder(s). When there is/are the retarded start cylinder(s), the process returns to step S104 and it is determined whether the magnitude of the intake piping negative pressure has exceeded the reference value $\alpha$. That is, when the retarded start cylinder(s) is/are set, the determinations in step S101, S106, and S104 are repeatedly performed until the magnitude of the intake piping negative pressure exceeds the reference value $\alpha$.

After the start-up of the engine 1 has been completed, the amount of fuel to be injected into the normal start cylinder(s) is changed from the start-up injection amount to a post-start injection amount. The post-start injection amount is the injection amount calculated based on the intake air amount. More specifically, the value obtained by multiplying the base injection amount proportional to the intake air amount by an increasing coefficient determined based on the water temperature is set as the post-start injection amount. The intake air amount can be measured by an air flow meter (not shown).

When the magnitude of the intake piping negative pressure exceeds the reference value $\alpha$, the result of determination in step S104 becomes Yes, and the process executed by the electronic control unit 10 proceeds to step S105. In step S105, the retardation flag described above is cleared and set to off. This process cancels the setting of the retarded start cylinder(s) and fuel injection is sequentially started in the retarded start cylinder(s), in which fuel injection has been stopped. In this event, the fuel injection amount may be set to the amount significantly reduced as compared to the start-up injection amount of the normal start cylinder(s) as shown in FIG. 3.

If fuel injection is started from the same cycle for all the retarded start cylinders, the torque can rapidly increase, which can cause the engine speed to jump up. Thus, it is preferable that the number of retarded start cycles, by which start of fuel injection is retarded, be set for each of the retarded start cylinders so that the cycle, from which fuel injection is started, is varied between the retarded start cylinders. In other words, it is preferable that a certain number of cycles be designated as the transition period from the operation (partial cylinder operation), in which the engine operates only with the normal start cylinder(s), to the operation (all cylinder operation), in which the engine operates with all the cylinders including the retarded start cylinder(s).

As described above, according to the first embodiment, the engine 1 is started by injecting fuel into the normal start cylinder(s), which is part of the cylinders, so that it is possible to reduce the total amount of fuel injection required to start the engine 1 as compared to the case where the engine 1 is started by performing fuel injection into all the cylinders. In addition, the fuel injection into the remaining, retarded start cylinder(s) is started after the magnitude of the intake piping negative pressure exceeds the reference value, so that vaporization of the fuel of the initial injection into the retarded start cylinder(s) is promoted. Thus, it is possible to significantly reduce the amount of initial injection of fuel into the retarded start cylinder(s) as compared to the amount of fuel injection into the normal start cylinder(s). Thus, according to the first embodiment, the total amount of fuel injected from when the engine 1 is started until the engine reaches the normal operation is reduced and therefore, it is possible to suppress the discharge of unburned HC from the cylinders 2 to the exhaust manifolds 5.

Second Embodiment

Figure 4:
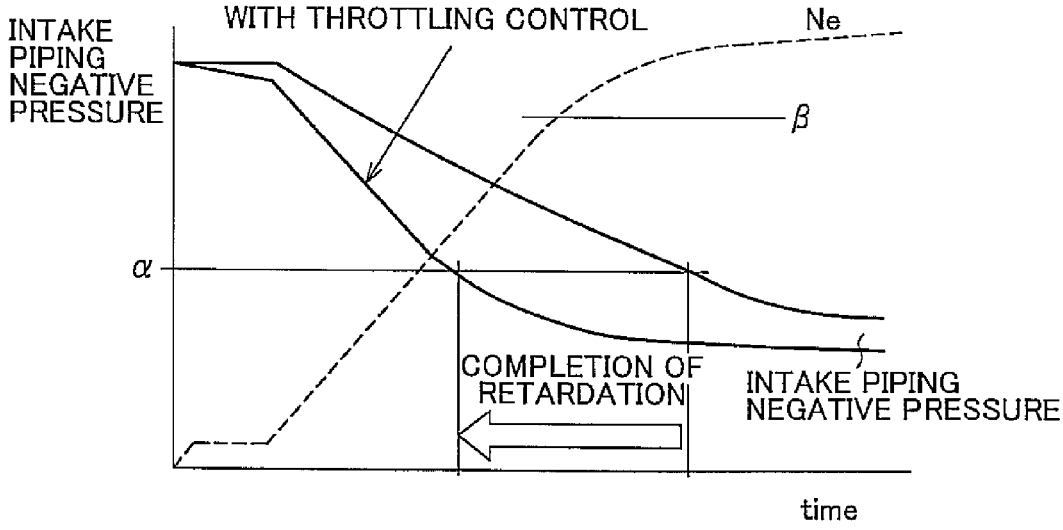
FIG. 4 is a schematic diagram of throttling control of a throttle that is performed by a controller of a second embodiment of the invention.

Next, a second embodiment of the invention will be described with reference to FIGS. 4 and 5.

The controller of the second embodiment is used in the engine configured as shown in FIG. 1 as in the case of the first embodiment. Thus, the following description will be made on the assumption that the engine shown in FIG. 1 is used, as in the case of the first embodiment. The controller of the second embodiment is implemented as part of functions of the electronic control unit 10 as in the case of the first embodiment.

A feature of the second embodiment is that control is performed that actively increases the magnitude of the intake piping negative pressure in parallel with the retardative start control of the first embodiment. As a method of actively increasing the magnitude of the intake piping negative pressure, in the second embodiment, a method is employed, in which the throttle 8 is throttled, more specifically, the throttle 8 is fully closed. The intake piping negative pressure depends on the balance between the amount of air that flows into the surge tank 3 through the throttle 8 and the amount of air that flows out of the surge tank 3 into the cylinders 2. Thus, when the throttle 8 is fully closed, the air in the surge tank 3 is used only and the magnitude of the intake piping negative pressure increases at a speed higher than ordinary speeds. Although the throttle 8 is fully closed in this case, the effect is obtained when the degree of opening of the throttle 8 is reduced below the degree that is determined based on the amount of air required to run the engine 1.

The reason why the magnitude of the intake piping negative pressure is actively increased in the second embodiment is that it becomes possible to quickly activate the catalyst. FIG. 4 is a schematic diagram of throttling control of the throttle 8 that is performed by the electronic control unit 10 in the second embodiment. As shown in this diagram, when the throttle 8 is throttled in parallel with the retardative start control of the first embodiment, the time taken for the magnitude of the intake piping negative pressure to exceed the reference value $\alpha$, is reduced, so that the start time of the fuel injection into the retarded start cylinder(s) is advanced. When the fuel injection into the retarded start cylinder(s) in addition to the fuel injection into the normal start cylinder(s) is started, the thermal energy that flows into the exhaust passage is increased and the activation of the catalyst disposed in the exhaust passage is promoted.

Figure 5:
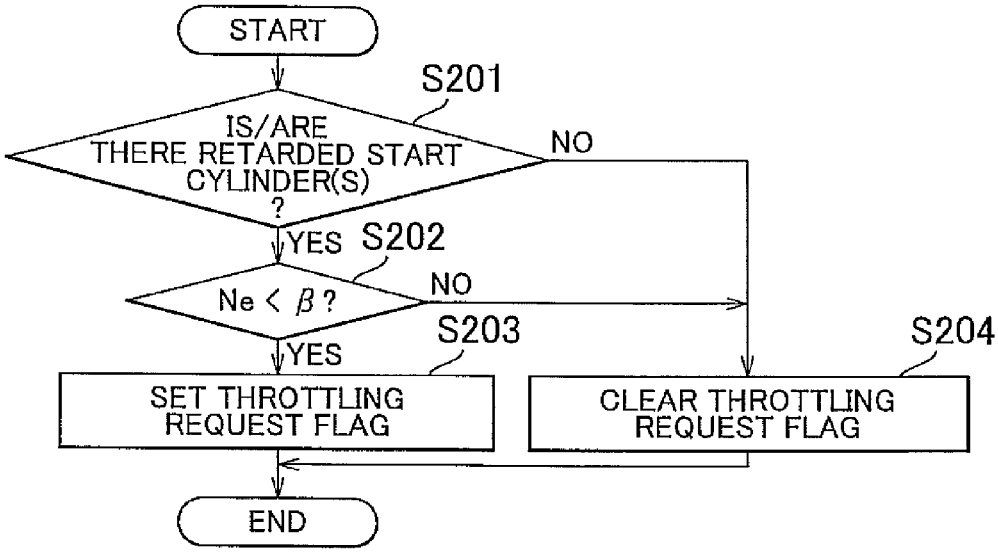
FIG. 5 is a flow chart showing a procedure of the throttling control of the throttle that is performed by the controller of the second embodiment of the invention.

FIG. 5 is a flow chart showing a procedure of the throttling control of the throttle 8 that is performed by the electronic control unit 10 in the second embodiment. In step S201, which is the first step of the throttling control shown in FIG. 5, it is determined based on the above-described retardation flag whether there is/are the retarded start cylinder(s). When the retardation flag is on, that is, when the retarded start cylinder(s) is/are set, the process proceeds to step S202.

In step S202, it is determined whether an engine speed Ne is lower than a predetermined guard value $\beta$. When the engine speed Ne becomes high, consumption of the air in the surge tank 3 is promoted. Thus, when the throttle 8 is fully closed, it becomes impossible to supply, into the cylinders, the air required to run the engine 1, which can result in the stall of the engine 1. The above guard value $\beta$ is a threshold value set in view of such a fact and is set to secure the minimum intake air volume that is required to run the engine 1.

While it is determined as a result of determination in step S202 that the engine speed Ne is lower than the guard value $\beta$, the process proceeds to step S203 and the throttling request flag is set. When the engine speed Ne becomes equal to or higher than the guard value $\beta$, the process proceeds to step S204 and the throttling request flag is cleared. While the throttling request flag is set, the electronic control unit 10 controls the throttle 8 so as to be fully closed. When the throttling request flag is cleared, the throttle 8 is released from the fully closed state and after that, the degree of opening of the throttle 8 is controlled to a degree of opening according to the required amount of air.

By performing the throttling control of the throttle 8 as described above in parallel with the retardative start control, it is possible to suppress the discharge of the unburned HC from the cylinders 2 into the exhaust manifolds 5 and at the same time, to quickly activate the catalyst disposed in the downstream exhaust passage. Thus, according to the second embodiment, it is possible to effectively suppress the discharge of the unburned HC to the outside of the system by quickly activating the catalyst.

Third Embodiment

Next, a third embodiment of the invention will be described with reference to FIG. 6.

The controller of the third embodiment is used in the engine 1 configured as shown in FIG. 1 as in the case of the first embodiment. Thus, the following description will be made on the assumption that the engine shown in FIG. 1 is used, as in the case of the first embodiment. In the third embodiment, the engine 1 is provided with a variable intake length system (not shown). As in the cases of the other embodiments, the controller of the third embodiment is implemented as part of functions of the electronic control unit 10.

A feature of the third embodiment is that control is performed that actively increases the magnitude of the intake piping negative pressure in parallel with the retardative start control of the first embodiment. The third embodiment differs from the second embodiment in the means for actively increasing the magnitude of the intake piping negative pressure. In the third embodiment, a variable intake length system is used. More specifically, the length of the intake piping is fixed so as to be minimized by the variable intake length system. When the length of the intake piping is minimized, the volume of the intake piping is also minimized and the magnitude of the intake piping negative pressure increases at a speed higher than ordinary speeds.

Figure 6:
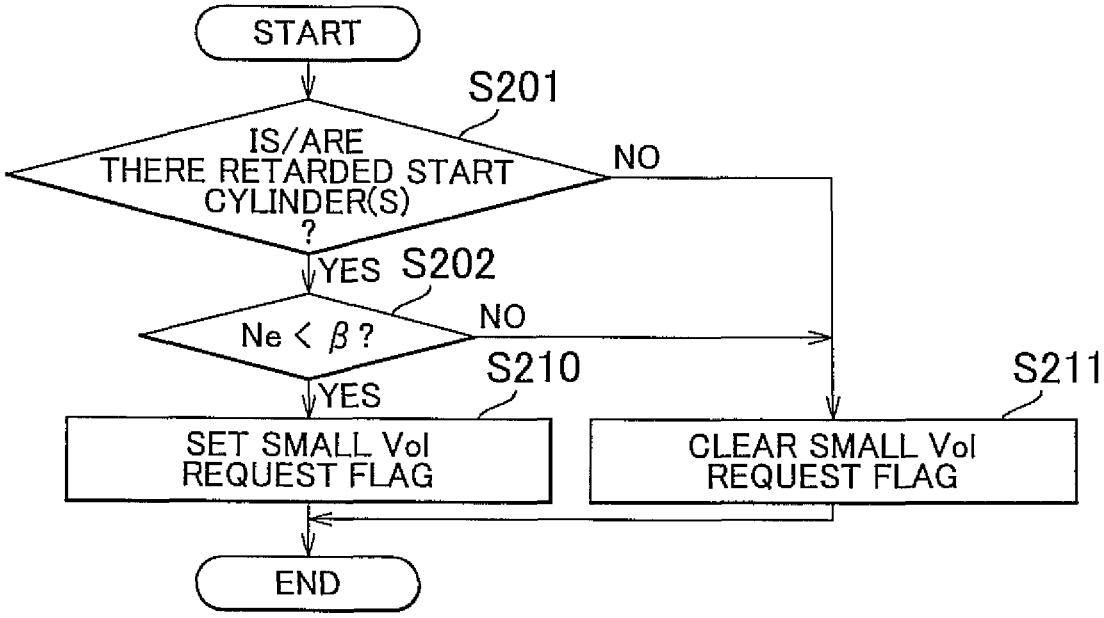
FIG. 6 is a flow chart showing a procedure of intake-piping length varying control that is performed by a controller of a third embodiment of the invention.

FIG. 6 is a flow chart showing a procedure of the intake-piping length varying control that is performed by the electronic control unit 10 in the third embodiment. In this flow chart, the steps the same as those of the throttling control of the second embodiment are designated by the same step numbers.

In step S201, which is the first step of the intake-piping length varying control shown in FIG. 6, it is determined based on the above-described retardation flag whether there is/are the retarded start cylinder(s). When the retardation flag is off, that is, when no retarded start cylinder is set, the subsequent steps are skipped. On the other hand, when the retardation flag is on, that is, when the retarded start cylinder(s) is/are set, the process proceeds to step S202.

In step S202, it is determined whether the engine speed Ne is lower than the guard value β. While it is determined as a result of determination in step S202 that the engine speed Ne is lower than the guard value β, the process proceeds to step S210 and a small Vol request flag is set. When the engine speed Ne exceeds the guard value β, the process proceeds to step S211 and the small Vol request flag is cleared. While the small Vol request flag is set, the electronic control unit 10 fixes the length of the intake piping so as to minimize the length by the variable intake length system. When the small Vol request flag is cleared, the fixation of the length of the intake piping is released and after that, the length of the intake piping is controlled according to the operating status of the engine 1.

By performing the above-described intake-piping length varying control in parallel with the retardative start control, the time taken for the magnitude of the intake piping negative pressure to exceed the reference value α is reduced, so that the start time of the fuel injection into the retarded start cylinder(s) is advanced. As a result, it is possible to suppress the discharge of the unburned HC from the cylinders 2 into the exhaust manifolds 5 and at the same time, to quickly activate the catalyst disposed in the exhaust passage. Thus, according to the third embodiment, it is possible to effectively suppress the discharge of the unburned HC to the outside of the system by quickly activating the catalyst, as in the case of the second embodiment.

Fourth Embodiment

Next, a fourth embodiment of the invention will be described with reference to FIG. 7.

The controller of the fourth embodiment is used in the engine 1 configured as shown in FIG. 1 as in the case of the first embodiment. Thus, the following description will be made on the assumption that the engine shown in FIG. 1 is used, as in the case of the first embodiment. It should be noted that, in the fourth embodiment, the engine 1 is provided with a variable valve timing (VVT) system and an exhaust gas recirculation (EGR) system. The VVT system varies a timing of at least one of intake valves or exhaust valves of the internal combustion engine. The controller of the fourth embodiment is implemented as part of functions of the electronic control unit as in the cases of the other embodiments.

The VVT system and the EGR system are used to control torque in the engine 1. However, when the retardative start control described in the above description of the first embodiment is performed, until the fuel injection into the retarded start cylinder(s) is started, the engine 1 is operated with the use of the normal start cylinder(s) only and therefore, the torque produced by the engine 1 is small. When the VVT system and/or the EGR system are operated under such circumstances, the torque produced by the normal start cylinder(s) is reduced, which can cause a delay in increase of the engine speed.

A feature of the fourth embodiment is that, instead of the retardative start control of the first embodiment, another mode of retardative start control is performed that is modified to address the above problem. FIG. 7 is a flow chart showing a procedure of the retardative start control that is performed by the electronic control unit 10 in the fourth embodiment. In this flow chart, the steps the same as those of the retardative start control of the first embodiment are designated by the same step numbers.

Figure 7:
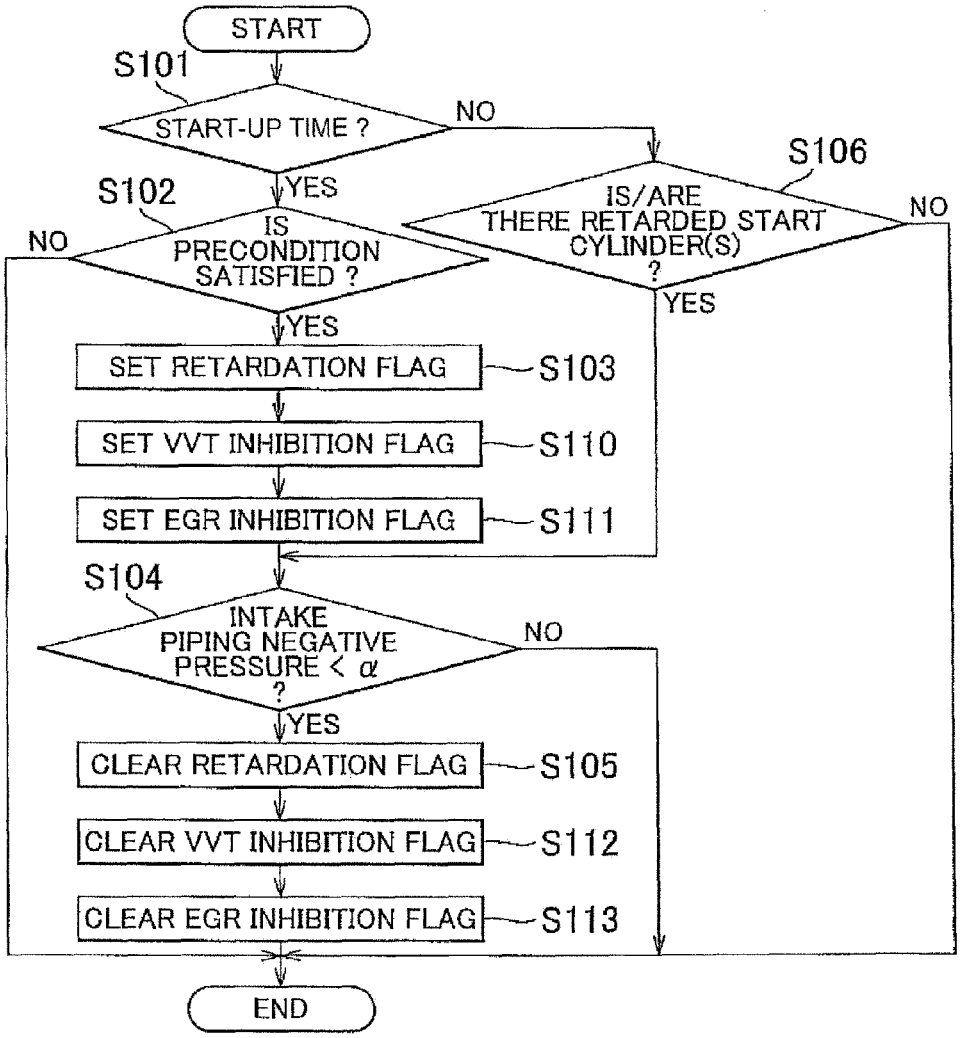
FIG. 7 is a flow chart showing a procedure of retardative start control that is performed by a controller of a fourth embodiment of the invention.

In step S101, which is the first step of the retardative start control shown in FIG. 7, it is determined whether the present time is in the start-up time. When it is determined that the present time is in the start-up time, the process proceeds to step S102 and it is determined whether the precondition for setting the retarded start cylinder(s) is satisfied. The result of determination in step S102 is reflected on the setting of the retardation flag and the setting of a VVT inhibition flag and an EGR inhibition flag to be described later. The initial settings of the flags are off. When the result of determination in step S102 is no, the flags are kept off. In this case, the processes of the following steps are skipped.

When the result of determination in step S102 is yes, the process proceeds to step S103 and the retardation flag is set to on. When the retardation flag is set to on, the retarded start cylinder(s) is/are set and the fuel injection into the cylinder(s) that is/are set as the retarded start cylinder(s) is stopped.

In the next step S110, the VVT inhibition flag is set to on. In the subsequent step S111, the EGR inhibition flag is set to on. The VVT system is controlled by another control program than that for the retardative start control. The control program determines whether the VVT inhibition flag is on or off and when the VVT inhibition flag is on, the control program inhibits operation of the VVT system. The EGR system is also controlled by another control program than that of the retardative start control. When the EGR inhibition flag is on, the control program inhibits operation of the EGR system.

In the next step S104, it is determined whether the magnitude of the intake piping negative pressure exceeds the reference value α. Until the magnitude of the intake piping negative pressure exceeds the reference value α, fuel injection into the retarded start cylinder(s) continues to be stopped. The operation of the VVT system and the EGR system also continues to be inhibited.

When the magnitude of the intake piping negative pressure exceeds the reference value α, the process proceeds to step S105, the retardation flag is cleared and returned to off. This process cancels the setting of the retarded start cylinder(s) and fuel injection is sequentially started in the retarded start cylinder(s), in which fuel injection has been stopped. In the next step S112, the VVT inhibition flag is cleared and returned to off. This process cancels the inhibition of operation of the VVT system and the control of the VVT system according to the operating status of the engine 1 is started. In the next step S113, the EGR inhibition flag is cleared and returned to off. This process cancels the inhibition of operation of the EGR system and the control of the EGR system according to the operating status of the engine 1 is started.

By performing the above-described retardative start control, it is possible to suppress the discharge of the unburned HC that accompanies the start of the engine 1 as in the case of the first embodiment. In addition, the operation of the VVT system and the operation of the EGR system that can become the disturbance of the start-up control are inhibited until the fuel injection into the retarded start cylinder(s) is started, so that it is ensured that the engine speed increases.

It is also possible to combine the throttling control of the throttle 8 of the second embodiment and/or the intake-piping length varying control of the third embodiment with the retardative start control of the fourth embodiment.

Fifth Embodiment

Next, a fifth embodiment of the invention will be described with reference to FIG. 8.

The controller of the fifth embodiment is used in the engine 1 configured as shown in FIG. 1 as in the case of the first embodiment. Thus, the following description will be made on the assumption that the engine shown in FIG. 1 is used, as in the case of the first embodiment. The controller of the fifth embodiment is implemented as part of functions of the electronic control unit 10 as in the cases of the other embodiments.

Various auxiliaries and electrical loads are connected to the engine 1, which are, for example, an air conditioning system, such as an air conditioner, heater, etc., a power steering system, headlights, wipers, power windows, brake lamps, etc. When these auxiliaries and the electrical loads operate, the torque produced by the engine 1 is more than a little used. When the retardative start control described in the description of the first embodiment is performed, until the fuel injection into the retarded start cylinder(s) is started, the engine 1 is operated with the use of the normal start cylinder(s) only and therefore, the torque produced by the engine 1 is small. When the auxiliaries and the electrical loads are operated under such circumstances, the torque produced by the engine 1 can fall short, which can cause a delay in increase of the engine speed.

A feature of the fifth embodiment is that, instead of the retardative start control of the first embodiment, another mode of retardative start control is performed that is modified to address the above problem. FIG. 8 is a flow chart showing a procedure of the retardative start control that is performed by the electronic control unit 10 in the fifth embodiment. In this flow chart, the steps the same as those of the retardative start control of the first embodiment are designated by the same step numbers.

Figure 8:
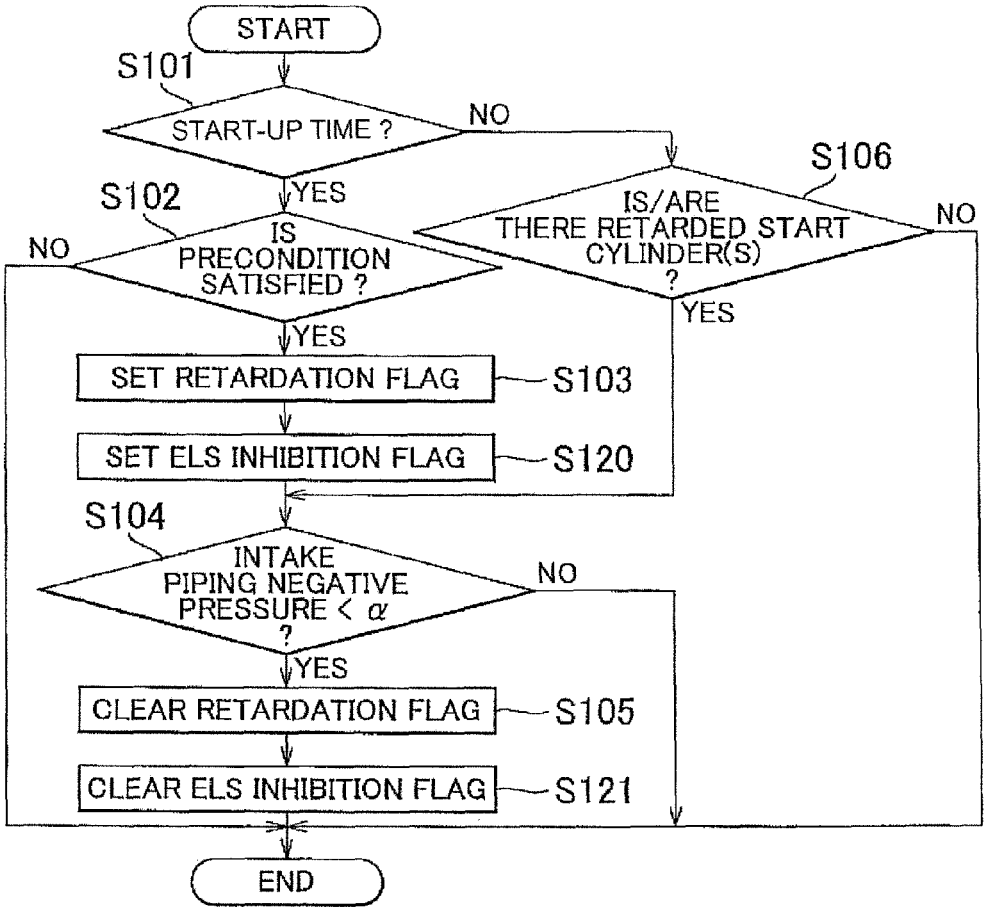
FIG. 8 is a flow chart showing a procedure of retardative start control that is performed by a controller of a fifth embodiment of the invention.

In step S101, which is the first step of the retardative start control shown in FIG. 8, it is determined whether the present time is in the start-up time. When it is determined that the present time is in the start-up time, the process proceeds to step S102 and it is determined whether the precondition for setting the retarded start cylinder(s) is satisfied. The result of determination in step S102 is reflected on the setting of the retardation flag and the setting of an ELS inhibition flag to be described later. The initial settings of these flags are off. When the result of determination in step S102 is no, the flags are kept off. In this case, the processes of the following steps are skipped.

When the result of determination in step S102 is yes, the process proceeds to step S103 and the retardation flag is set to on. When the retardation flag is set to on, the retarded start cylinder(s) is/are set and the fuel injection into the cylinder(s) that is/are set as the retarded start cylinder(s) is stopped.

In the next step S120, the ELS inhibition flag is set to on. The ELS inhibition flag is a flag for inhibiting operation of the auxiliaries and the electrical loads other than safety devices, such as brake lamps. The program that controls operation of the subject auxiliaries and electrical loads inhibits operation of the subject devices when the ELS inhibition flag is on.

In the next step S104, it is determined whether the magnitude of the intake piping negative pressure exceeds the reference value $\alpha$. Until the magnitude of the intake piping negative pressure exceeds the reference value $\alpha$, fuel injection into the retarded start cylinder(s) continues to be stopped. The operation of the auxiliaries and electrical loads also continues to be inhibited.

When the magnitude of the intake piping negative pressure exceeds the reference value $\alpha$, the process proceeds to step S105, the retardation flag is cleared and returned to off. This process cancels the setting of the retarded start cylinder(s) and fuel injection is sequentially started in the retarded start cylinder(s), in which fuel injection has been stopped. In the next step S121, the ELS inhibition flag is cleared and returned to off. This process cancels the inhibition of the operation of the auxiliaries and electrical loads and the operation of the auxiliaries and electrical loads according to the need is started.

By performing the above-described retardative start control, it is possible to suppress the discharge of the unburned HC that accompanies the start of the engine 1 as in the case of the first embodiment. In addition, the operation of the auxiliaries and electrical loads that can become the disturbance of the start-up control is inhibited until the fuel injection into the retarded start cylinder(s) is started, so that it is ensured that the engine speed increases.

It is also possible to combine the throttling control of the throttle 8 of the second embodiment and/or the intake-piping length varying control of the third embodiment with the retardative start control of the fifth embodiment.

Sixth Embodiment

Next, a sixth embodiment of the invention will be described with reference to FIGS. 9 to 11.

The controller of the sixth embodiment is used in the engine 1 configured as shown in FIG. 1 as in the case of the first embodiment. Thus, the following description will be made on the assumption that the engine shown in FIG. 1 is used, as in the case of the first embodiment. The controller of the sixth embodiment is implemented as part of functions of the electronic control unit 10 as in the cases of the other embodiments.

Figure 9:
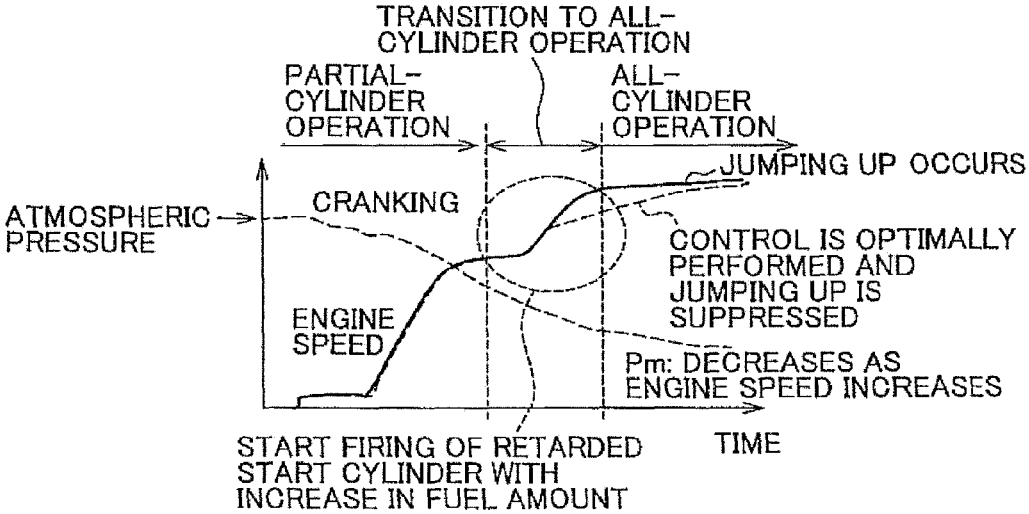
FIG. 9 is a diagram showing both the behavior of the rotational speed of an internal combustion engine and the variation in intake piping pressure when operation is changed from partial-cylinder operation to all-cylinder operation.

FIG. 9 is a diagram showing both the behavior of the rotational speed of the engine 1 and the variation in the intake piping pressure when operation is changed from partial-cylinder operation to all-cylinder operation. The partial-cylinder operation herein means the operation, in which the engine is operated with the use of the normal start cylinder(s) only. The all-cylinder operation herein means the operation after the initial fuel injection has been completed for all the retarded start cylinder(s). As shown in this diagram, the engine speed increases due to the partial-cylinder operation after starting cranking and the engine speed further increases due to the change from the partial-cylinder operation to the all-cylinder operation. The intake piping pressure is gradually reduced from the atmospheric pressure as the engine speed increases. That is, the magnitude of the intake piping negative pressure gradually increases.

In FIG. 9, two lines, a solid line and a broken line, are drawn as the curves showing the behavior of the rotational speed of the engine 1 after starting cranking. The behavior of the rotational speed shown by the broken line is an ideal behavior of the rotational speed that is obtained by the optimum start-up control. On the other hand, in the behavior of the rotational speed shown by the solid line, the engine speed jumps up during the transition from the partial-cylinder operation to the all-cylinder operation. The engine speed jumps up in this way when the combustion air-fuel ratio becomes excessively rich at the time of the initial fuel injection into the retarded start cylinder(s). Causing the combustion air-fuel ratio to be excessively rich leads to the occurrence of the unburned HC and the jumping up of the engine speed can cause noise and vibrations. On the other hand, it is conceivable that the combustion air-fuel ratio becomes excessively lean at the time of the initial fuel injection into the retarded start cylinder(s). In this case, causing the combustion air-fuel ratio to be excessively lean can cause misfiring, which can lead not only to reduction of the engine speed but also to production of a large amount of unburned HC. In view of these problems, it should be understood how important the setting of the amount of initial fuel injection into the retarded start cylinder(s) during the transition from the partial-cylinder operation to the all-cylinder operation is.

A feature of the sixth embodiment is the retardative start control to be performed by the electronic control unit 10, more specifically, the setting of the amount of initial fuel injection into the retarded start cylinder(s). After all, the deviation in combustion air-fuel ratio as described above occurs because the vaporization characteristics of the fuel in the intake port varies every time. Thus, in the sixth embodiment, the amount of initial fuel injection into the retarded start cylinder(s) is determined according to the intake piping pressure and the intake port temperature, that is, the vaporization characteristics of fuel, so as to make the combustion air-fuel ratio the stoichiometric air-fuel ratio.

Figure 10:
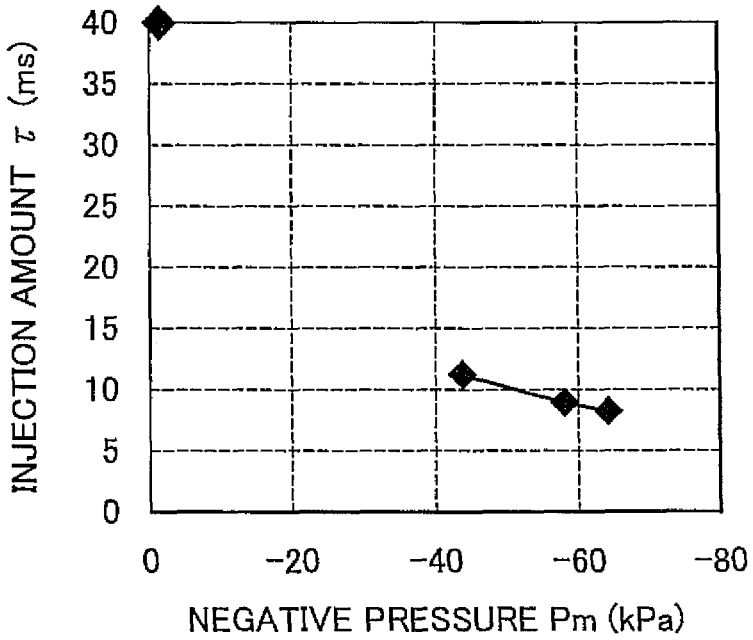
FIG. 10 is a diagram showing a map, used in a controller of a sixth embodiment of the invention, for determining the fuel injection amount of retarded start cylinder(s) based on an intake piping negative pressure.

FIG. 10 is a diagram showing a map for determining the fuel injection amount $\tau$ of the retarded start cylinder(s) based on the intake piping negative pressure Pm. In this map, the minimum amount of fuel injection that is required to achieve the stoichiometric air-fuel ratio is associated with the intake piping negative pressure Pm.

This map is set so that the fuel injection amount $\tau$ decreases as the magnitude of the intake piping negative pressure Pm increases. As described in the description of the first embodiment, the condition for starting the fuel injection into the retarded start cylinder(s) is that the magnitude of the intake piping negative pressure Pm exceeds the reference value. Thus, no fuel injection amount $\tau$ is associated with the magnitudes of the intake piping negative pressures Pm that are lower than the reference value (about −40 kPa in FIG. 10).

Figure 11:
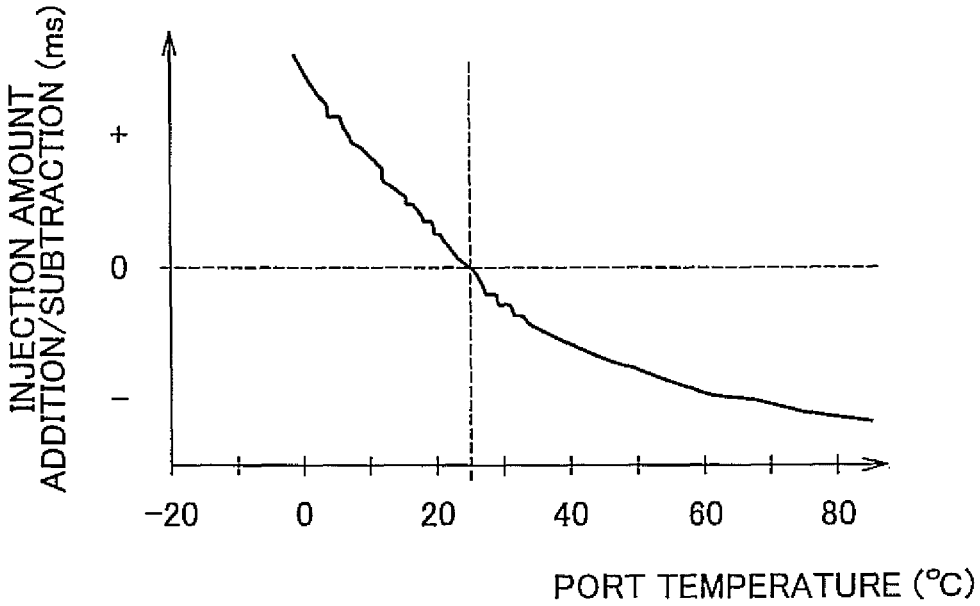
FIG. 11 is a diagram showing a map, used in the controller of the sixth embodiment of the invention, for determining a correction amount for correcting the fuel injection amount based on an intake port temperature.

FIG. 11 is a diagram showing a map used to determine a correction amount (injection amount addition/subtraction value) for correcting the fuel injection amount $\tau$ based on the intake port temperature. The intake port temperature can be estimated from the coolant temperature in the engine 1. However, the intake port temperature may be measured directly. This map is set so that the correction amount is negative and increases in absolute value as the intake port temperature increases above a certain reference temperature (25° C. in FIG. 11) and the correction amount is positive and increases as the intake port temperature decreases below the reference temperature.

While the retardative start control is performed, when it is detected that the measured magnitude of the intake piping negative pressure Pm exceeds the reference value, the electronic control unit 10 searches the map shown in FIG. 10 with the use of the measured intake piping negative pressure Pm as a key and retrieves the fuel injection amount $\tau$ corresponding to the intake piping negative pressure Pm. Next, the electronic control unit 10 searches the map shown in FIG. 11 with the use of the measured value or the estimated value of the present intake port temperature as a key and retrieves the correction amount corresponding to the intake port temperature. The electronic control unit 10 then sets the fuel injection amount finally obtained by adding the correction amount to the fuel injection amount $\tau$, as the amount of initial injection of fuel into the retarded start cylinder(s).

By setting the amount of initial injection of fuel into the retarded start cylinder(s) in the above-described way, it is possible to make the combustion air-fuel ratio the stoichiometric air-fuel ratio, so that it becomes possible to more reliably suppress the discharge of unburned HC. In addition, it is possible to prevent the engine speed from jumping up during the transition from the partial-cylinder operation to the all-cylinder operation.

It is preferable that the method of setting the amount of initial injection of fuel into the retarded start cylinder used in the sixth embodiment be used in the retardative start control of the first embodiment. In addition, the feature of the sixth embodiment may be combined with the features of the other embodiments as appropriate in implementing the invention.

Seventh Embodiment

Next, a seventh embodiment of the invention will be described.

The controller of the seventh embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the seventh embodiment is implemented as part of functions of the electronic control unit 10.

A feature of the seventh embodiment is control to prevent, in advance, the engine speed from jumping up during the transition from the partial-cylinder operation to the all-cylinder operation. In the seventh embodiment, the throttle 8 is closed a predetermined degree prior to the start of the fuel injection into the retarded start cylinder(s). When the degree of opening of the throttle 8 is reduced, the amount of air taken into the cylinders is reduced and the torque produced by the cylinders is reduced. Thus, by reducing the intake air amount in synchronization with the timing, at which combustion in the retarded start cylinder(s) is started, it is possible to prevent the jumping up of the engine speed that accompanies the start of combustion in the retarded start cylinder(s). What is important is the timing, at which the throttle 8 is closed. The proper timing can be obtained through calculation by taking account of the volume of the entire intake piping, mainly the volume of the surge tank 3, and the degree of closing of the throttle 8.

It is preferable that the jumping-up prevention control as described above be used in the retardative start control of the first embodiment. In addition, the jumping-up prevention control of the seventh embodiment may be combined with the features of the other embodiments as appropriate in implementing the invention. In particular, when the jumping-up prevention control of the seventh embodiment is combined with the sixth embodiment, it becomes possible to more effectively prevent the jumping up of the engine speed.

Eighth Embodiment

Next, an eighth embodiment of the invention will be described with reference to FIGS. 12 and 13.

The controller of the eighth embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the eighth embodiment is implemented as part of functions of the electronic control unit 10.

A feature of the eighth embodiment is control performed so that the jumping up of the engine speed that occurs during the transition from the partial-cylinder operation to the all-cylinder operation is suppressed after the occurrence of the jumping up. In the eighth embodiment, when the fuel injection into the retarded start cylinder(s) is started, the gradient of the change in the engine speed is measured for a predetermined period of time after the start of the fuel injection. When the jumping up of the engine speed is detected based on the gradient, the setting of the retarded start cycle number(s) of the retarded start cylinder(s), by which the start of the fuel injection is retarded in the retarded start cylinder(s), that is, the number of cycles, in which the fuel injection is stopped, is immediately changed. More specifically, the retarded start cycle number(s) for the retarded start cylinder(s) is/are increased to suppress the increase in the torque produced by the engine 1.

The jumping-up prevention control described above will be described in more detail with reference to the drawings. FIG. 12 is a diagram showing an example of a basic setting pattern of the retarded start cycle numbers of the respective cylinders. In the example shown in FIG. 12, the number of the stop cylinders in the partial-cylinder operation, that is, the number of the retarded start cylinders is set to four. The cylinder marked with a circle is the firing cylinder and the cylinder marked with a cross is the stop cylinder in the table. The first cylinder (#1) in the table is the cylinder, the fuel injection timing of which comes first after the identification of the cylinders and fuel injection is performed in the first cylinder. The cylinder numbers in the table indicate the firing order. The second cylinder (#2), the fourth cylinder (#4), the sixth cylinder (#6), and the eighth cylinder (#8) are set as the retarded start cylinders. In other words, the retarded start cylinders are set alternately in the firing order.

In the example shown in FIG. 12, the fuel injection into the second cylinder is started from the first cycle in the transition from the partial-cylinder operation to the all-cylinder operation and the number of stop cylinders is changed to three. The fuel injection into the third cylinder is started from the subsequent, second cycle and the number of stop cylinders is changed to two. The fuel injection into the sixth cylinder is started from the subsequent, third cycle and the number of stop cylinders is changed to one. The fuel injection into the eighth cylinder is started from the fourth cycle and the transition from the partial-cylinder operation to the all-cylinder operation is thus completed.

It is assumed that the jumping up of the engine speed has been detected at the second cycle after starting the fuel injection into the retarded start cylinder. In this case, the setting of the retarded start cycle number for each of the cylinders is changed according to the pattern shown in FIG. 13. In the changed setting pattern, the retarded start cycle numbers are increased at and after the cycle subsequent to the cycle, at which the jumping up of the engine speed is detected. In the standard setting pattern, the fuel injection into the sixth cylinder is started from the third cycle. In the changed setting pattern, however, the fuel injection in the third cycle is stopped and the fuel injection is started from the fourth cycle. In the standard setting pattern, the fuel injection into the eighth cylinder is started from the fourth cycle. In the changed setting pattern, however, the fuel injection into the eighth cylinder is stopped until the fifth cycle and is started from the sixth cycle. In this way, the completion of the transition from the partial-cylinder operation to the all-cylinder operation is delayed until the sixth cycle, so that increase in the torque produced by the engine 1 is suppressed until the sixth cycle.

Although, in the example shown in FIG. 13, the retarded start cycle number is increased in increments of two cycles, the retarded start cycle number may be increased in increments of three cycles. Alternatively, the retarded start cycle number may be changed depending on the cylinders. When the above case is taken as an example for explanation, the increment of the retarded start cycle number for the sixth cylinder may be two cycles and the increment of the retarded start cycle number for the eighth cylinder may be three cycles. The setting of the retarded start cycle number is not limited as long as the increase in the torque produced by the engine 1 is suppressed and it is therefore made possible to suppress the jumping up of the engine speed.

The jumping-up prevention control as described above can be used in the retardative start control of the fourth embodiment or the fifth embodiment in addition to the retardative start control of the first embodiment. When the eighth embodiment is combined with the sixth embodiment, it is possible to more effectively suppress the jumping up of the engine speed. The eighth embodiment may be combined with the seventh embodiment. In the jumping-up prevention control of the seventh embodiment, the restriction of the intake air amount by throttling the throttle 8 is limited and there is a possibility that the jumping up of the engine speed cannot be perfectly prevented. However, when the jumping-up prevention control of the eighth embodiment is combined, it becomes possible to maximally suppress the jumping up of the engine speed.

Ninth Embodiment

Next, a ninth embodiment of the invention will be described.

The controller of the ninth embodiment is used in the engine 1 configured as shown in FIG. 1 as in the case of the first embodiment. Thus, the following description will be made on the assumption that the engine shown in FIG. 1 is used, as in the case of the first embodiment. It should be noted that, in the ninth embodiment, the engine 1 is provided with a variable valve timing system on the exhaust side (EX-VVT). As in the cases of the other embodiments, the controller of the ninth embodiment is implemented as part of functions of the electronic control unit 10.

As in the case of the seventh embodiment, a feature of the ninth embodiment is control to prevent, in advance, the engine speed from jumping up during the transition from the partial-cylinder operation to the all-cylinder operation. In the ninth embodiment, the valve overlap is increased by operating the EX-WT so as to increase the EGR rate in synchronization with the timing of the intake stroke of the retarded start cylinder, in which combustion is started first. The increase in the EGR rate reduces the torque produced by the cylinders, so that rapid increase in torque in the engine as a whole is suppressed even when combustion is started in the retarded start cylinder. Thus, it is made possible to suppress the jumping up of the engine speed that accompanies the start of combustion in the retarded start cylinder(s).

It is preferable that the jumping-up prevention control as described above be used in the retardative start control of the first embodiment. In addition, the jumping-up prevention control of the ninth embodiment may be combined with the features of the other embodiments as appropriate in implementing the invention. In particular, when the jumping-up prevention control of the ninth embodiment is combined with the sixth embodiment, it becomes possible to more effectively prevent the jumping up of the engine speed.

Tenth Embodiment

Next, a tenth embodiment of the invention will be described.

The controller of the tenth embodiment is used in the engine 1 configured as shown in FIG. 1 as in the case of the first embodiment. Thus, the following description will be made on the assumption that the engine shown in FIG. 1 is used, as in the case of the first embodiment. It should be noted that, in the tenth embodiment, the engine 1 is provided with an EGR system. As in the cases of the other embodiments, the controller of the tenth embodiment is implemented as part of functions of the electronic control unit 10.

As in the cases of the seventh and ninth embodiments, a feature of the tenth embodiment is control to prevent, in advance, the engine speed from jumping up during the transition from the partial-cylinder operation to the all-cylinder operation. In the tenth embodiment, EGR gas is introduced into the cylinders by operating the EGR system so as to increase the EGR rate in synchronization with the timing of the intake stroke of the retarded start cylinder, in which combustion is started first. The increase in the EGR rate reduces the torque produced by the cylinders, so that rapid increase in torque in the engine as a whole is suppressed even when combustion is started in the retarded start cylinder. Thus, it is possible to suppress the jumping up of the engine speed that accompanies the start of combustion in the retarded start cylinder(s). It should be noted that the introduction of the EGR gas is stopped by operating the EGR system again after the transition to the all-cylinder operation is completed.

It is preferable that the jumping-up prevention control as described above be used in the retardative start control of the first embodiment. In addition, the jumping-up prevention control of the tenth embodiment may be combined with the features of the other embodiments as appropriate in implementing the invention. In particular, when the jumping-up prevention control of the tenth embodiment is combined with the sixth embodiment, it becomes possible to more effectively prevent the jumping up of the engine speed.

Eleventh Embodiment

An eleventh embodiment of the invention will be described with reference to FIG. 14.

The controller of the eleventh embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the eleventh embodiment is implemented as part of functions of the electronic control unit 10.

As in the cases of the seventh, ninth, and tenth embodiments, a feature of the eleventh embodiment is control to prevent, in advance, the engine speed from jumping up during the transition from the partial-cylinder operation to the all-cylinder operation. In the eleventh embodiment, before starting the fuel injection into the retarded start cylinder(s), the air-fuel ratio (combustion air-fuel ratio) of the mixture supplied to the normal start cylinder(s), in which combustion is started from the beginning of the start-up, is set leaner than the stoichiometric air-fuel ratio. More specifically, the combustion air-fuel ratio is set leaner than the stoichiometric air-fuel ratio by reducing the post-start injection amount so that the torque produced by the normal start cylinder(s) is reduced. Then, the fuel injection into the retarded start cylinder(s) is started, so that it becomes possible to prevent the jumping up of the engine speed that accompanies the start of combustion in the retarded start cylinder(s).

The jumping-up prevention control described above will be described in more detail with reference to the drawings. FIG. 14 is a diagram showing a setting pattern of the retarded start cycle numbers of the respective cylinders, to which the jumping-up prevention control of the eleventh embodiment is applied. The cylinder marked with a circle is the firing cylinder, the cylinder marked with a cross is the stop cylinder, and the cylinder marked with a triangle is the lean burn cylinder in the table. In the example shown in FIG. 14, the retarded start cylinders are the second cylinder, the fourth cylinder, the sixth cylinder, and the eighth cylinder. The partial-cylinder operation is performed by the first cylinder, the third cylinder, the fifth cylinder, and the seventh cylinder. In the first cycle during the transition from the partial-cylinder operation to the all-cylinder operation, the combustion mode in the first cylinder is changed to the lean burn and subsequently, fuel injection into the second cylinder is started. In the subsequent, second cycle, first, the combustion mode in the third cylinder is changed to the lean burn and subsequently, fuel injection into the fourth cylinder is started. In the subsequent, third cycle, first, the combustion mode in the fifth cylinder is changed to the lean burn and subsequently, fuel injection into the sixth cylinder is started. In the subsequent, fourth cycle, first, the combustion mode in the seventh cylinder is changed to the lean burn and subsequently, fuel injection into the eighth cylinder is started. In this way, the transition from the partial-cylinder operation to the all-cylinder operation is completed. After the transition to the all-cylinder operation is completed, the combustion air-fuel ratio of all the cylinders is gradually changed to a predetermined air-fuel ratio according to the catalyst warm-up control.

As described above, the combustion mode in the cylinders, in which combustion has already been started, is gradually changed to the lean burn as the fuel injection into the retarded start cylinders is gradually started, so that it is possible to prevent rapid increase in the torque produced by the engine 1. However, the cylinders, in which the combustion mode is changed to the lean burn, are the normal start cylinders only. The combustion mode in the retarded start cylinder(s), in which the combustion has been started, is not changed to the lean burn. This is because, in the retarded start cylinders, in which fuel is not supplied at the time of starting the engine, the temperature of the cylinder wall surfaces and the temperature of the neighboring portions thereof are low and therefore, combustion is more likely to become unstable. On the other hand, in the normal start cylinder(s), in which fuel is supplied from the beginning, the cylinder wall surfaces and the neighboring portions thereof have been warmed and the combustion therein is therefore stable, so that the lean burn is possible.

It is preferable that the jumping-up prevention control as described above be used in the retardative start control of the first embodiment. In addition, the jumping-up prevention control of the eleventh embodiment may be combined with the features of the other embodiments as appropriate in implementing the invention. In particular, when the jumping-up prevention control of the eleventh embodiment is combined with the sixth embodiment, it becomes possible to more effectively prevent the jumping up of the engine speed.

Twelfth Embodiment

Next, a twelfth embodiment of the invention will be described.

The controller of the twelfth embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the twelfth embodiment is implemented as part of functions of the electronic control unit 10.

As in the cases of the seventh, ninth, tenth, and eleventh embodiments, a feature of the twelfth embodiment is control to prevent, in advance, the engine speed from jumping up during the transition from the partial-cylinder operation to the all-cylinder operation. In the twelfth embodiment, after a predetermined number of cycles have passed since the start of fuel injection into the normal start cylinder(s), the ignition timing of the normal start cylinder(s) is retarded, and then fuel injection into the retarded start cylinder(s) is started. In addition, the amount of retardation of the ignition timing of the normal start cylinder(s) is increased every time the number of retarded start cylinder(s), in which fuel injection has been started, increases. Retardation of the ignition timing reduces the torque produced by the normal start cylinder(s) and such reduction in torque moderates the rapid increase in torque caused by the start of combustion in the retarded start cylinder(s).

As described above, the ignition timing of the cylinder(s), in which combustion has been started, is retarded as the fuel injection into the retarded start cylinder(s) is gradually started, so that it is possible to prevent the engine speed from jumping up by adjusting the torque produced by the engine 1 to a desired torque. However, retardation of the ignition timing is performed only in the normal start cylinder(s). The ignition timing of the retarded start cylinder(s), in which combustion has been started, is not retarded. This is because, in the retarded start cylinders, in which fuel is not supplied at the time of starting the engine, the temperature of the cylinder wall surfaces and the neighboring portions thereof is low and therefore, combustion is more likely to become unstable. On the other hand, in the normal start cylinder(s), in which fuel is supplied from the beginning, the cylinder wall surfaces and the neighboring portions thereof have been warmed up and the combustion therein is therefore stable, so that the lean burn is possible.

It is preferable that the jumping-up prevention control as described above be used in the retardative start control of the first embodiment. In addition, the jumping-up prevention control of the twelfth embodiment may be combined with the features of the other embodiments as appropriate in implementing the invention. In particular, when the jumping-up prevention control of the twelfth embodiment is combined with the sixth embodiment, it becomes possible to more effectively prevent the jumping up of the engine speed.

Thirteenth Embodiment

A thirteenth embodiment of the invention will be described with reference to FIG. 15.

The controller of the thirteenth embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the thirteenth embodiment is implemented as part of functions of the electronic control unit 10.

The thirteenth embodiment is a further improvement of the twelfth embodiment. In the twelfth embodiment, the amount of retardation of the ignition timing of the normal start cylinder(s) is increased every time the number of retarded start cylinder(s), in which fuel injection has been started, increases. Depending on the setting of the amount of retardation, however, there is a case where the ignition timing is retarded over the retardation limit in terms of torque fluctuation. In this case, torque produced by the engine 1 fluctuates, which can cause noise and vibrations of the vehicle. Thus, in the thirteenth embodiment, when the ignition timing of the normal start cylinder(s) is retarded over the retardation limit in terms of torque fluctuation, the ignition timing of the retarded start cylinder(s), in which combustion has been started, is advanced. This makes it possible to keep the torque fluctuation in the engine as a whole at or below an acceptable level.

Figures 14, 15:
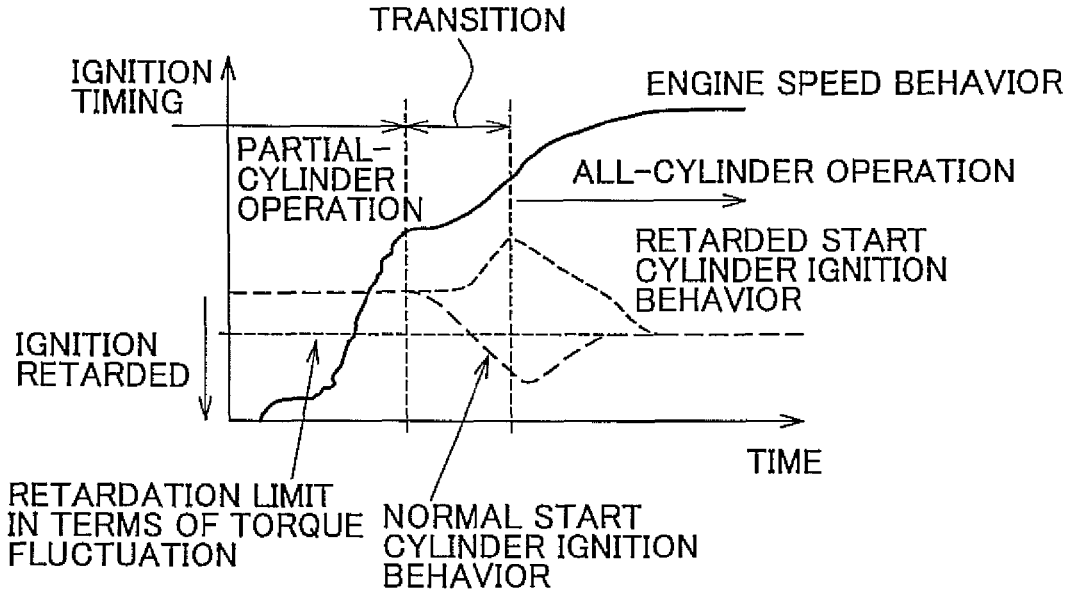
FIG. 14 is a diagram showing a setting pattern of the retarded start cycle numbers of the respective cylinders, which is used in a controller of an eleventh embodiment of the invention.
FIG. 15 is a diagram for explaining ignition timing control performed in a controller of a thirteenth embodiment of the invention.

FIG. 15 is a diagram showing the result of performing the ignition timing control as described above, in the form of a time chart. In FIG. 15, the broken line represents the behavior of the ignition timing of the normal start cylinder(s) (initial combustion cylinder(s)) and the dotted line represents the behavior of the ignition timing of the retarded start cylinder(s). The solid line represents the behavior of the rotational speed of the engine 1. After the transition to the all-cylinder operation is completed, the ignition timing of the normal start cylinder(s) is gradually advanced toward a predetermined ignition timing according to the catalyst warm-up control and the ignition timing of the retarded start cylinder(s) is gradually retarded toward a predetermined ignition timing according to the catalyst warm-up control.

Fourteenth Embodiment

Next, a fourteenth embodiment of the invention will be described with reference to FIGS. 16 to 20.

The controller of the fourteenth embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the fourteenth embodiment is implemented as part of functions of the electronic control unit 10.

An example of the setting of the retarded start cylinder(s) in the partial-cylinder operation is shown in FIG. 12 mentioned above. In this case, the cylinder, the fuel injection timing of which comes first after the identification of the cylinders, is a normal start cylinder, and the cylinder, the fuel injection timing of which comes next, is a retarded start cylinders. The normal start cylinders and the retarded start cylinders are set alternately in the firing order. When the retarded start cylinders are arranged at regular intervals in the firing order of the cylinders, the engine speed during the start-up time is caused to smoothly increase and a favorable start-up feeling is brought about.

In the case of the setting pattern shown in FIG. 12, however, when the torque produced by the cylinder, in which fuel injection is performed first (first cylinder in FIG. 12), is insufficient, the next cylinder (second cylinder in FIG. 12) is the retarded start cylinder that produces no torque and therefore, the speed of the engine 1 does not immediately increase. In this case, there is a possibility of engine stall. Even when the engine stall does not occur, at least the completion of the start of the engine is delayed and therefore, the start of the catalyst warm-up control, which is performed after the completion of the transition to the all-cylinder operation, is also delayed. Thus, in view of minimizing the discharge of unburned HC, it is desired to ensure the increase in the engine speed during the start-up time.

Figures 16, 17:
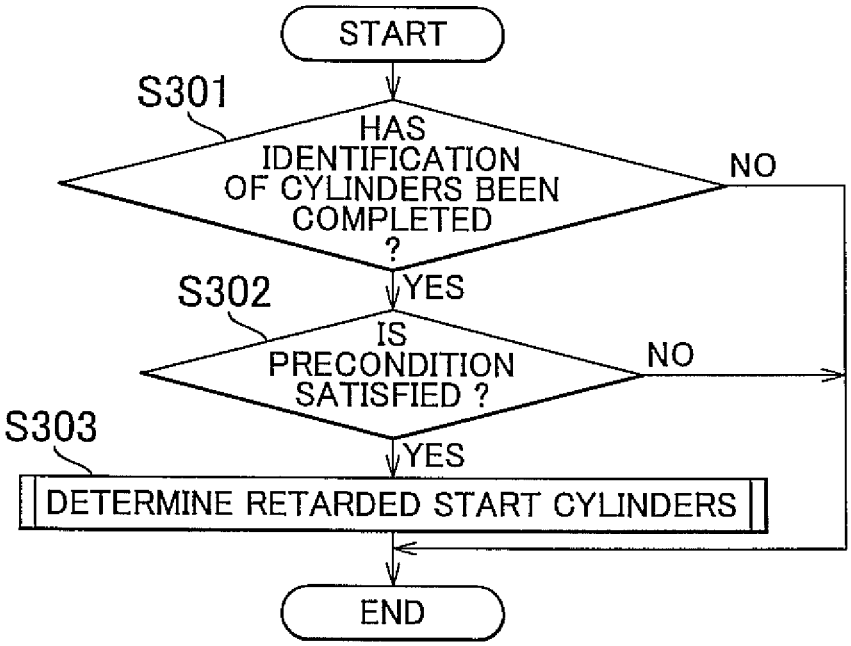
FIG. 16 is a flow chart showing a procedure of determining retarded start cylinders performed by a controller of a fourteenth embodiment of the invention.
FIG. 17 is a table for determining retarded start cylinders, which is used in the controller of the fourteenth embodiment of the invention.

A feature of the fourteenth embodiment is the retardative start control performed by the electronic control unit 10, more specifically, the setting of the retarded start cylinder(s) in the partial-cylinder operation. The retarded start cylinder(s) is/are set based on the result of the identification of the cylinders that is performed at the time of cranking. FIG. 16 is a flow chart showing part of the retardative start control that relates to determination of the retarded start cylinder(s). In the first step S301, it is determined whether the identification of the cylinders has been completed. In the identification of the cylinders, it is determined whether the value of a current crank counter CCRNK is any one of 1, 5, 8, 11, 13, 17, 20, and 23. The crank counter CCRNK is a counter that is counted up from 0 to 23 every 30-degree crank angle. The crank angle and the stroke of each cylinder are determined based on the value of the crank counter. The cylinder identification method using the crank counter CCRNK is well known and further description thereof is omitted.

In step S302, it is determined whether the precondition for setting the retarded start cylinder(s) is satisfied. The precondition is that the torque required to start the engine 1 can be obtained even when the retarded start cylinder(s) is/are set. This determination is made based on the information on the environment, such as water temperature and ambient temperature. When it is determined in step S302 that the precondition is satisfied, the process proceeds to step S303 and the retarded start cylinder(s) is/are determined based on the result of cylinder identification.

In determining the retarded start cylinder(s) in step S303, a retarded-start-cylinder determination table shown in FIG. 17 is used. The retarded-start-cylinder determination table is a table that associates the values of the crank counter CCRNK, 1, 5, 8, 11, 13, 17, 20, and 23 with the cylinder numbers of the cylinders that are to be set as the retarded start cylinders. For example, when the value of the crank counter CCRNK is 23, the second, the first, the third, and the sixth cylinders are set as the retarded start cylinders. It should be noted that the cylinder numbers shown in the tables of FIGS. 12 and 13 are the numbers representing the firing order after the identification of the cylinders, whereas the cylinder numbers shown in the table of FIG. 17 differ from those in the tables of FIGS. 12 and 13 and are the unique numbers assigned to the respective cylinders.

The retarded start cylinders determined based on the retarded-start-cylinder determination table are the third, the fourth, the seventh, and the eighth cylinders in the firing order. When viewed from another aspect, this means that the first, the second, the fifth, and the sixth cylinders in the firing order are set as the normal start cylinders. That is, in the fourteenth embodiment, fuel injection is consecutively performed in the next cylinder in addition to the first cylinder after the cylinder identification.

Figure 18:
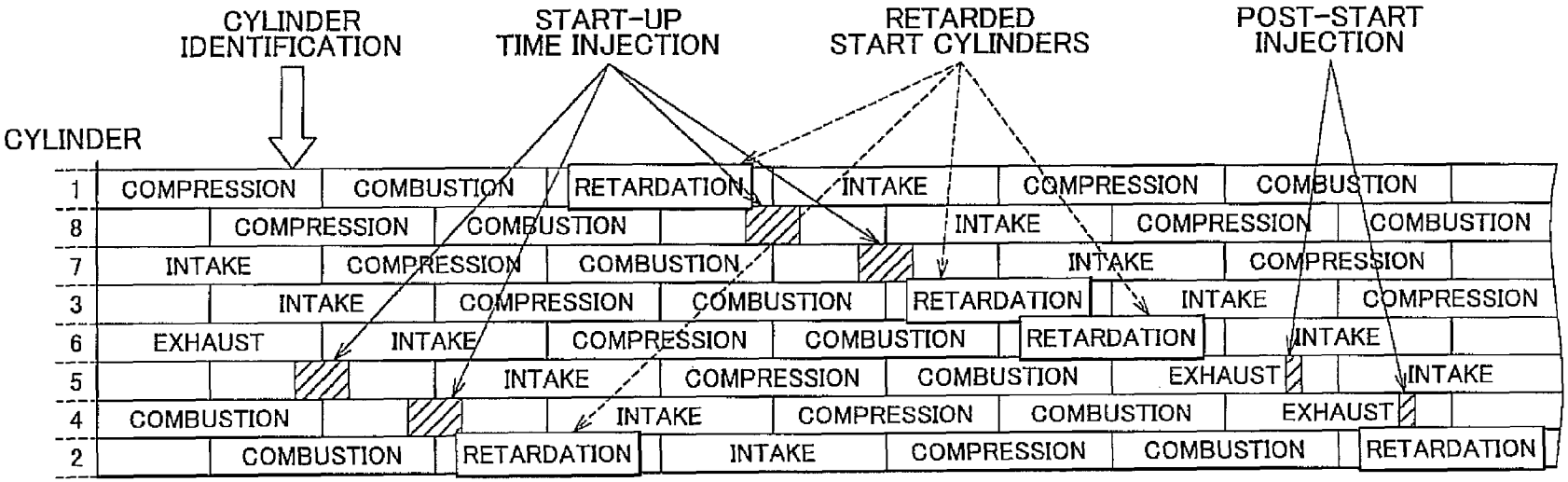
FIG. 18 shows an injection timing table used in the controller of the fourteenth embodiment of the invention.

The result of determination of the retarded start cylinders is reflected on the preparation of an injection timing table. The injection timing table is a table that shows the fuel injection timing of each cylinder along with stroke schedules of the cylinders. FIG. 18 shows an example of such an injection timing table. As shown in this table, the firing order of the cylinders is 1-8-7-3-6-5-4-2, and the injection timing repeatedly comes according to this order. In the example shown in FIG. 18, the first fuel injection (start-up injection) is performed in the fifth cylinder, the fuel injection timing of which comes immediately after the cylinder identification has been completed. The start-up injection is consecutively performed also in the fourth cylinder, the fuel injection timing of which comes next. The subsequent second and first cylinders are set as the retarded start cylinders and the start-up injection is consecutively performed in the eighth and seventh cylinders. The subsequent third and sixth cylinders are set as the retarded start cylinders. The cylinder, the fuel injection timing of which comes next, is again the first cylinder and thereafter, a post-start injection amount of fuel that is significantly less than the start-up injection amount is injected into the normal start cylinders.

Figure 19:
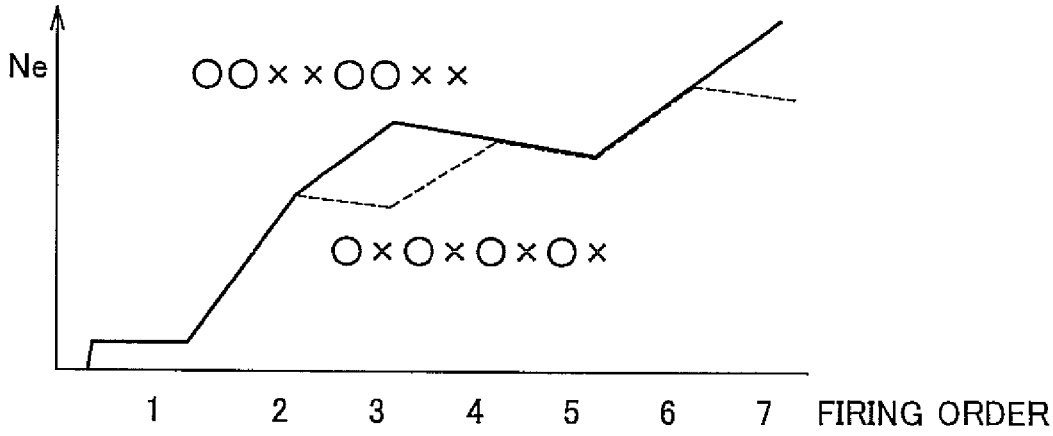
FIG. 19 is a diagram showing the behavior of the rotational speed of the internal combustion engine during start-up operation performed by the controller of the fourteenth embodiment of the invention, together with the behavior thereof of a comparative example.
Figure 20:
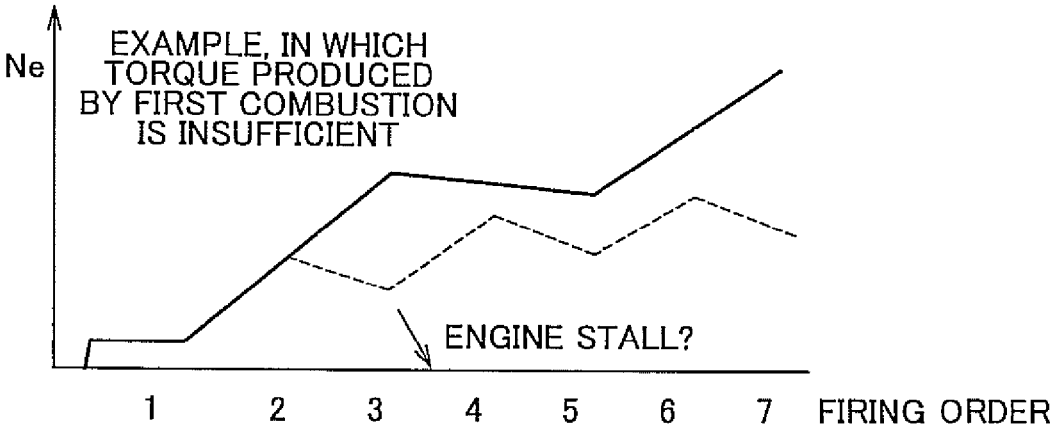
FIG. 20 is a diagram showing the behavior of the rotational speed of the internal combustion engine during start-up operation performed by the controller of the fourteenth embodiment of the invention, together with the behavior thereof of a comparative example.

FIGS. 19 and 20 are diagrams showing the behavior of the rotational speed of the engine 1 when the method of setting the retarded start cylinders, which is a feature of the fourteenth embodiment, is used in the retardative start control, along with the behavior thereof in the case of a comparative example. A setting pattern of the retarded start cylinders shown in FIG. 12, that is, a setting pattern, in which the normal start cylinders and the retarded start cylinders are alternately set, is herein taken as a comparative example. In FIGS. 18 and 19, the solid line represents the behavior of the rotational speed of the engine 1 when the fuel injection is performed according to the injection timing table shown in FIG. 18, while the broken line represents the behavior of the rotational speed of the engine 1 according to the comparative example.

FIG. 19 shows the behavior of the rotational speed of the engine 1 when a sufficient amount of torque is produced in the first combustion cylinder, that is, the first fired cylinder. In this case, although the behavior of the rotational speed differs depending on the ignition intervals that are determined by the setting pattern of the retarded start cylinders, a favorable increase in rotational speed is exhibited in both cases of the fourteenth embodiment (solid line) and the comparative example (broken line).

On the other hand, FIG. 20 shows the behavior of the rotational speed of the engine 1 when the torque produced in the first combustion cylinder is insufficient. In this case, the next cylinder is a retarded start cylinder that produces no torque in the case of the comparative example (broken line), so that the rotational speed of the engine 1 does not immediately increase. Depending on the circumstances, there is a possibility of engine stall. On the other hand, according to the fourteenth embodiment (solid line), the next cylinder is the normal start cylinder and therefore, the rotation is assisted by the torque produced by this cylinder, so that a favorable increase in rotational speed is exhibited, As described above, in the fourteenth embodiment, fuel injection is always performed in the cylinder, the fuel injection timing of which comes next the cylinder, in which fuel injection is performed first. According to the fourteenth embodiment, it is possible to increase the robustness of the start-up operation. This is because, even when the torque produced by the cylinder, in which fuel injection is performed first, is insufficient, the rotation at the time of starting the engine is assisted by the torque produced in the subsequent cylinder.

It is preferable that the method of setting the retarded start cylinder(s) in the partial-cylinder operation that is employed in the fourteenth embodiment be used in the retardative start control of the first embodiment. In addition, the feature of the fourteenth embodiment may be combined with the features of the other embodiments as appropriate in implementing the invention.

Fifteenth Embodiment

Next, a fifteenth embodiment of the invention will be described with reference to FIGS. 21 to 25.

The controller of the fifteenth embodiment is used in the engine 1 configured as shown in FIG. 1 as in the case of the first embodiment. Thus, the following description will be made on the assumption that the engine shown in FIG. 1 is used, as in the case of the first embodiment. As in the cases of the other embodiments, the controller of the fifteenth embodiment is implemented as part of functions of the electronic control unit 10.

A feature of the fifteenth embodiment is to determine the combustion conditions in the engine 1 with the use of the method of setting the retarded start cylinder(s) according to the fourteenth embodiment. It becomes possible to optimize the combustion conditions in the cylinders during the start-up time by determining the combustion conditions in the engine 1 immediately after starting the engine 1 and then reflecting the determination result on the control parameters related to the combustion conditions in the cylinders to be fired. First, a method of determining the combustion conditions in the engine 1 will be described with reference to FIG. 21.

Figure 21:
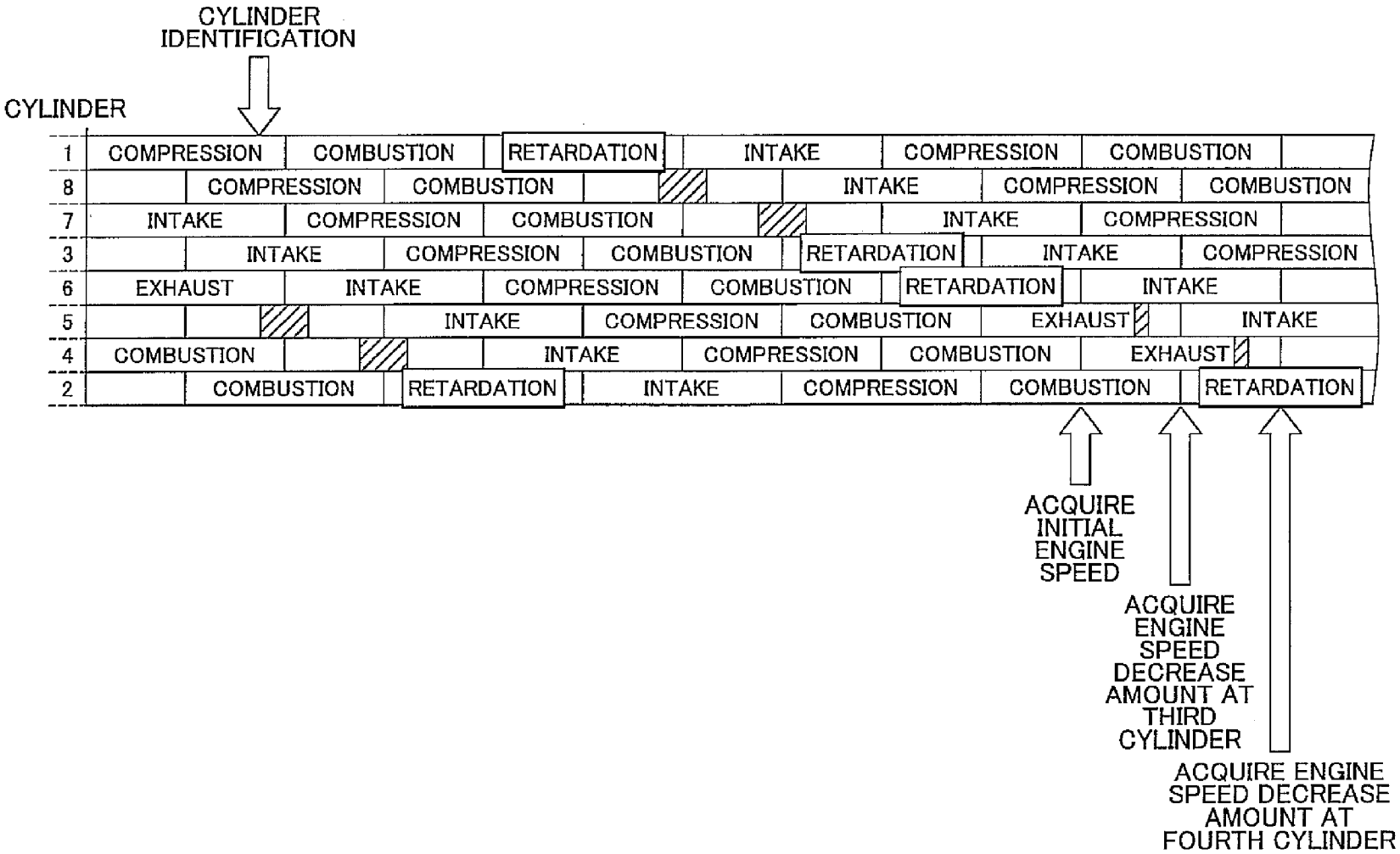
FIG. 21 shows an injection timing table used in a controller of a fifteenth embodiment of the invention.

FIG. 21 shows an example of the injection timing table, on which the result of setting the retarded start cylinders is reflected. As shown in this injection timing table, when the method of setting the retarded start cylinders according to the fourteenth embodiment is used, the first cylinder (cylinder No. 5) and the second cylinder (cylinder No. 4) in the firing order are the normal start cylinders and the third cylinder (cylinder No. 2) and the fourth cylinder (cylinder No. 1) in the firing order are the retarded start cylinders. Thus, during the start-up time, the rotational speed of the engine 1 is increased by the torque produced by the first and second cylinders and the engine 1 is rotated by inertia while the third and the fourth cylinders are in an expansion stroke (combustion stroke).

The combustion conditions in the engine 1 can be evaluated from the torque (indicated torque) produced by the engine 1. It is, however, difficult to directly measure the indicated torque itself. On the other hand, the engine rotational speed can be directly measured. The engine speed is however determined by torque and friction and therefore, the combustion conditions in the engine 1 cannot be determined only from the engine speed. For example, even when the combustion conditions in the engine 1 are the same, the engine speed is reduced when friction is large.

Thus, a conceivable measure is to take account of another parameter than the engine speed, as the information to be used to determine the combustion conditions in the engine L An easily conceivable method is to use the degree of increase in the engine speed during the start-up time, more specifically, the amount of increase per unit time or the amount of increase per stroke, as the another parameter. However, the increase in rotational speed caused by the combustion in the first and second cylinders is the increase from the cranking rotational speed and therefore, the degree of increase is large and variations are correspondingly large. Thus, the degree of increase in the engine speed at the time of starting the engine is not suitable as the information to be used to determine the combustion conditions.

When the focus is put on the third and fourth cylinders, these cylinders produce no torque. Therefore, it is considered that the behavior of the rotational speed while these cylinders are in the expansion stroke is determined by the amount of friction that is caused in the engine 1. Thus, in the fifteenth embodiment, in addition to the engine speed, the degree of decrease in engine speed when these cylinders are in the expansion stroke is used as the information. More specifically, the engine speed at the middle of the expansion stroke of the third cylinder (initial engine speed), the amount of decrease in the engine speed at the end of the expansion stroke of the third cylinder relative to the initial engine speed, and the amount of decrease in the engine speed at the end of the expansion stroke of the fourth cylinder relative to the initial engine speed are acquired and these pieces of information are used to determine the combustion conditions in the engine 1. In the injection timing table shown in FIG. 21, the timings, at which these pieces of information are acquired, are also shown.

Figure 22:
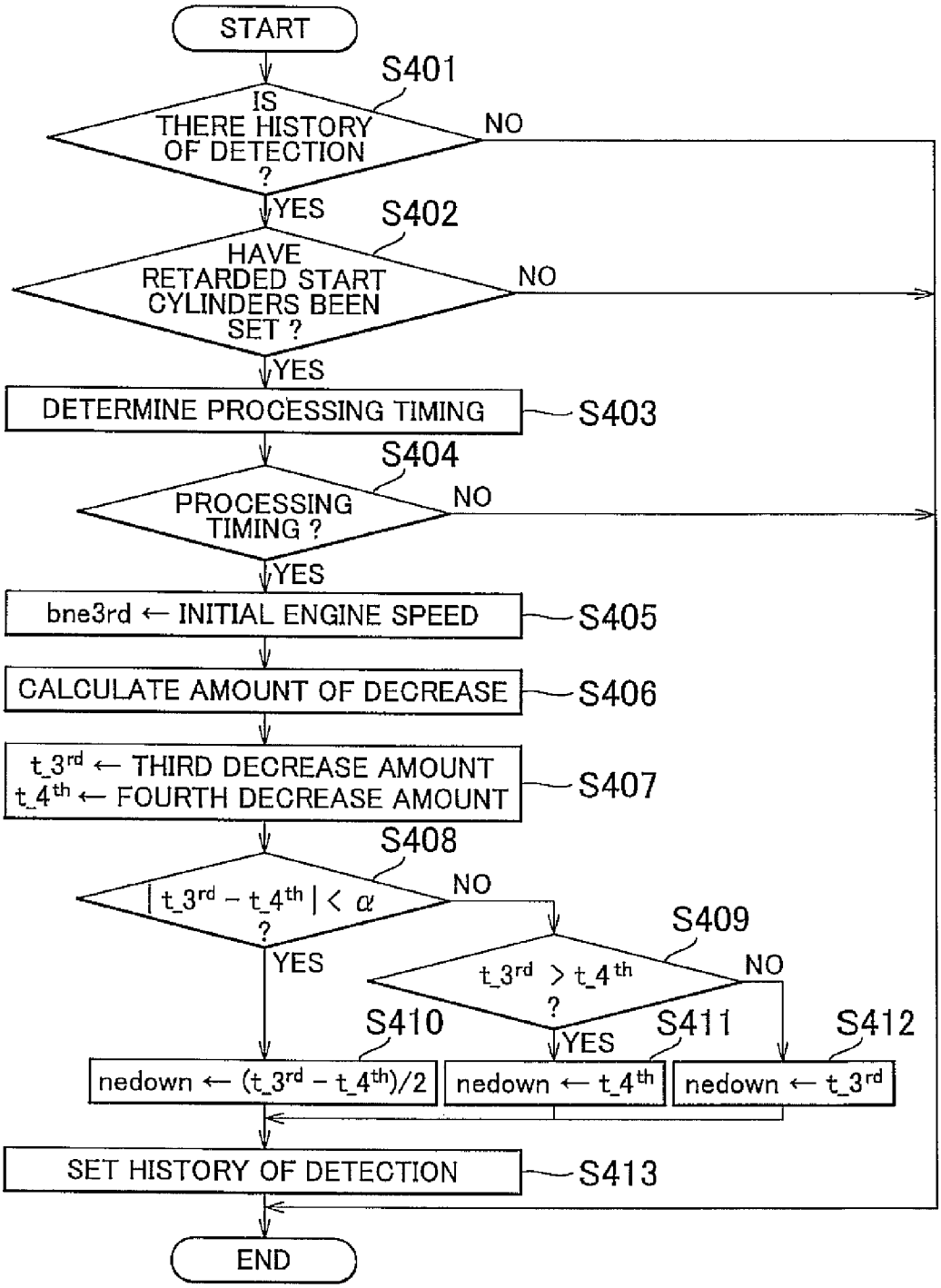
FIG. 22 is a flow chart showing a procedure of acquiring information to be used to determine combustion conditions, which is performed by the controller of the fifteenth embodiment of the invention.

FIG. 22 is a flow chart showing a detailed procedure of acquiring the information to be used to determine the combustion conditions in the engine 1. In the first step S401, it is determined whether there is the history of detection of the information. This information means the engine speed represented by a variable, bne3rd, and the rotational speed decrease amount represented by a variable, nedown. When there is history of detection of the information, the process proceeds to the next step S402.

In step S402, it is determined whether the retarded start cylinders are set. A procedure of setting the retarded start cylinders is as described in the description of the fourth embodiment. When the retarded start cylinders have already been set, the process proceeds to the next step S403.

In step S403, the processing timing is determined based on the result of setting the retarded start cylinders. The processing timing is the timing, at which the above-described pieces of information are acquired.

In step S404, it is determined whether the processing timing has come. When it is determined that the processing timing has come, the process proceeds to step S405.

In step S405, the engine speed at the middle of the expansion stroke of the third cylinder is acquired as the initial engine speed and the value is stored in the variable bne3rd.

In the next step S406, the amount of decrease in the engine speed at the end of the expansion stroke of the third cylinder relative to the initial engine speed (third decrease amount) and the amount of decrease in the engine speed at the end of the expansion stroke of the fourth cylinder relative to the initial engine speed (fourth decrease amount) are calculated.

In step S407, the third decrease amount calculated in step S406 is stored in a variable, $t_3^{rd}$, and the fourth decrease amount is stored in a variable, $t_4^{th}$.

In the next step S408, it is determined whether the absolute value of the difference between the variable $t_3^{rd}$ and the variable $t_4^{th}$ is smaller than a predetermined threshold $\alpha$. When the difference is smaller than the threshold $\alpha$, the process proceeds to step S410 and the mean value of the variable $t_3^{rd}$ and the variable $t_4^{th}$ is stored in the variable nedown.

On the other hand, when the difference between the variable $t_3^{rd}$ and the variable $t_4^{th}$ is equal to or higher than the threshold value $\alpha$, the process proceeds to step S409. In step S409, it is determined whether the value of the variable $t_3^{rd}$ is larger than the value of the variable $t_4^{th}$. When the value of the variable $t_3^{rd}$ is larger than the value of the variable $t_4^{th}$, the process proceeds to step S411 and the value of the variable $t_4^{th}$ that is the smaller value is stored in the variable nedown. On the other hand, when it is determined that the value of the variable Le is larger than the value of the variable $t_3^{rd}$, the process proceeds to step S412 and the value of the variable $t_3^{rd}$ that is the smaller value is stored in the variable nedown.

The value of the variable bne3rd obtained by the above-described procedure is the engine speed, which is used as the information to be used to determine the combustion conditions in the engine 1 and the value of the variable nedown is the rotational speed decrease amount, which is used as the information to be used to determine the combustion conditions in the engine 1. In the description below, these variables are expressed as the engine speed bne3rd and the rotational speed decrease amount nedown.

Next, a method of correcting control parameters based on the engine speed bne3rd and the rotational speed decrease amount nedown will be described. The control parameters to be corrected are control parameters related to the combustion conditions and, specifically, include a start-up time injection amount, a post-start injection amount, an injection timing, and an intake air amount. When the start-up time injection amount and the post-start injection amount are corrected to be increased, the torque produced by the firing cylinder(s) is increased and the insufficiency of the increase in engine speed is thus compensated. In the initial setting, in order to secure the time for fuel to vaporize, the injection timing is asynchronous to air intake (that is, before each intake valve is opened).

However, when the injection timing is changed to be synchronous with air intake (that is, after each intake valve is opened), the amount of fuel taken into the cylinders is increased and the torque is thus increased. In addition, when the correction is made to increase the intake air amount, the post-start injection amount of the cylinders is also automatically increased accordingly. Thus, it is possible to increase the torque more than in the case of the correction of the fuel injection amount or the injection timing.

Figure 23:
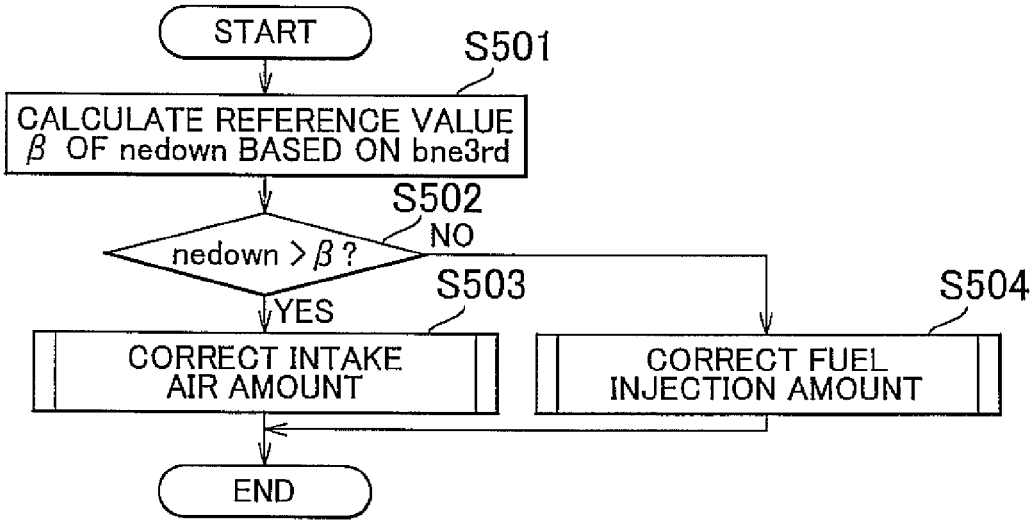
FIG. 23 is a flow chart showing a procedure of correcting a control parameter, which is performed by the controller of the fifteenth embodiment of the invention.
Figure 24:
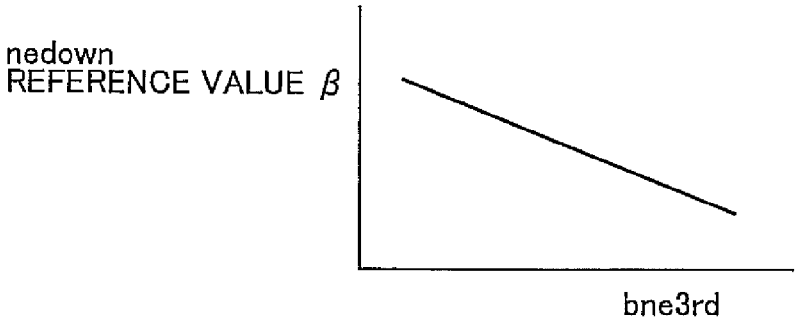
FIG. 24 is a diagram showing a map for determining a determination reference value of a rotational speed decrease amount based on an initial engine speed, which is used in the controller of the fifteenth embodiment of the invention.

As a procedure for correcting the control parameters as described above, the procedure shown by a flow chart shown in FIG. 23 may be employed, for example. In the first step S501, a determination reference value β of the rotational speed decrease amount nedown is determined based on the engine speed bne3rd. A map as shown in FIG. 24 is used in this determination. This map has a temperature axis (not shown) and the determination reference value β is associated with engine speed bne3rd and water temperature. When the engine speed is high, the inertia is large and therefore, the rotational speed decrease amount is reduced even when the value of friction is the same. Thus, the map is set so that the determination reference value β is reduced as the engine speed bne3rd increases.

Figure 25:
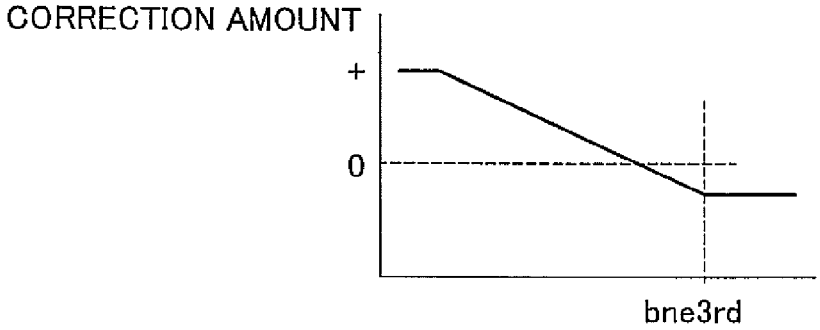
FIG. 25 is a diagram showing a map for determining the amount of correction of a control parameter based on an initial engine speed, which is used in the controller of the fifteenth embodiment of the invention.

In step S502, it is determined whether the rotational speed decrease amount nedown is larger than the determination reference value β. When the rotational speed decrease amount nedown is larger than the determination reference value β, that is, when the engine speed significantly decreases, the process proceeds to step S503 and the correction (increasing correction) of the intake air amount is made. The torque can be significantly increased by correcting the intake air amount and therefore, even when the decrease in engine speed is significant, it is possible to bring about a rapid recovery. On the other hand, when the rotational speed decrease amount nedown is equal to or smaller than the determination reference value β, that is, when the decrease in engine speed is small, the process proceeds to step S504 and the correction (increasing correction) of the fuel injection amount is made. The correction amount in each of the corrections is determined with the use of a map as shown in FIG. 25. This map has a temperature axis (not shown) and the correction amount is associated with engine speed bne3rd and water temperature. In this example of the map, the correction amount increases as the rotational speed bne3rd decreases.

As described above, according to the fifteenth embodiment, the control parameters related to the combustion conditions in the cylinder to be fired are corrected so that optimum combustion conditions are obtained. Thus, a good startability is ensured.

Sixteenth Embodiment

Next, a sixteenth embodiment of the invention will be described with reference to FIG. 26.

The controller of the sixteenth embodiment is used in the engine configured as shown in FIG. 1 as in the case of the first embodiment. Thus, the following description will be made on the assumption that the engine shown in FIG. 1 is used, as in the case of the first embodiment. The controller of the sixteenth embodiment is implemented as part of functions of the electronic control unit 10 as in the cases of the other embodiments.

Figure 26:
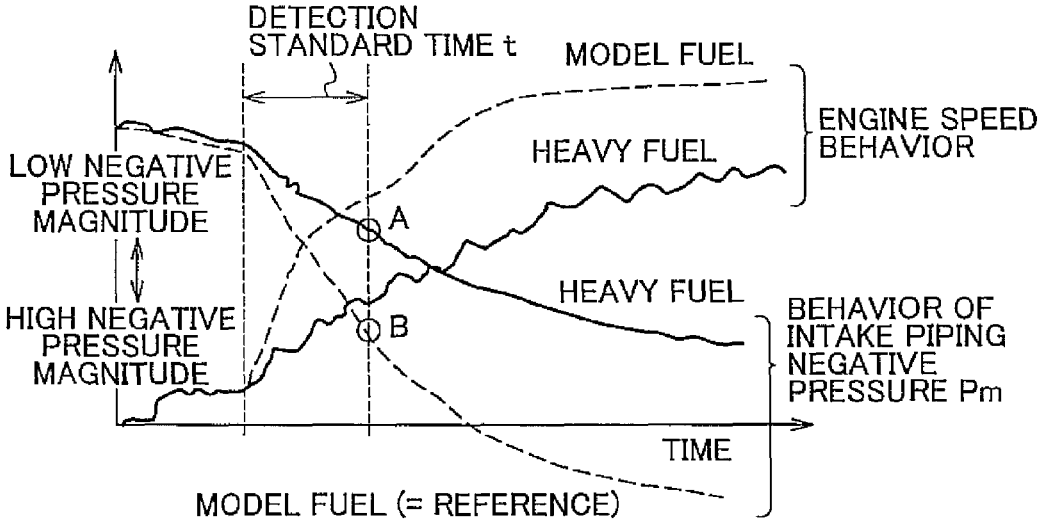
FIG. 26 is a diagram showing the behavior of the rotational speed of the internal combustion engine and the behavior of the intake piping negative pressure, each of which is compared between the case where model fuel is used and the case where heavy fuel is used.

FIG. 26 is a diagram showing the behavior of the rotational speed of the engine 1 and the behavior of the intake piping negative pressure during the partial-cylinder operation, each of which is compared between the case where model fuel is used and the case where heavy fuel is used. The model fuel herein means a fuel, such as LFG7, used in the optimization when the engine control specifications are determined. The broken line represents the behavior of the rotational speed and the behavior of the intake piping negative pressure when the model fuel is used. The solid line represents the behavior of the rotational speed and the behavior of the intake piping negative pressure when the heavy fuel is used. When these behaviors are compared with each other, it is apparent that the increase in engine speed is slow when the heavy fuel is used. In view of reduction of noise and vibrations, rapid increase in engine speed is required and therefore, when the heavy fuel is used, some measures are required.

When some measures are taken that are required when the heavy fuel is used, first of all, it is necessary to quickly detect that the heavy fuel is used. Although various methods have been proposed as the method of determining properties of fuel, there are few methods, by which the fuel properties can be accurately determined immediately after the engine 1 is started. In the sixteenth embodiment, the determination of the fuel properties, more specifically, the determination as to whether the heavy fuel is used is made by a unique method to be described below, which has never been used before.

A feature of the method of determining the fuel properties of the sixteenth embodiment is that the focus is put on the difference between the intake piping negative pressure behavior when the model fuel is used and the intake piping negative pressure behavior when the heavy fuel is used. As shown in FIG. 26, when the magnitude of the intake piping negative pressure at the same time point is compared between when the model fuel is used and when the heavy fuel is used, the magnitude of the intake piping negative pressure is lower when the heavy fuel is used. This is because the increase in engine speed is slower when the heavy fuel is used. Thus, it can be said that the more the intake piping negative pressure differs from the intake piping negative pressure when the model fuel is used, the greater the heaviness of fuel used is.

In the sixteenth embodiment, specifically, the intake piping negative pressure Pm is measured when a predetermined detection standard time, t, has elapsed since the first cylinder (first combustion cylinder) in the firing order was fired. The detection standard time t is set before the completion of the transition to the all-cylinder operation, which starts the fuel injection into a retarded start cylinder, and at the same time, the detection standard time t is set as a time period, during which the engine speed is surely increasing (this can be confirmed in advance through experiments). Then, the intake piping negative pressure Pm (indicated by point A in FIG. 26) obtained by measurement and the reference Pmr (indicated by point B in FIG. 26) of the model fuel are compared with each other and the difference is calculated. A value determined in advance by the optimization, in which the model fuel is used, is used as the reference Pmr. The difference between the measured intake piping negative pressure Pm and the reference Pmr (Pm difference) indicates the heaviness of the used fuel. It should be noted that there is a reason why the detection standard time t is used instead of a detection standard cycle number. This is because, when a heavy fuel is used, the engine speed varies even in the same cycle, which causes variations in the time taken for a certain number of cycles to be completed. However, this is not intended to exclude the cycle number from the candidates of the detection standard period. Needless to say, when the degree of variations is such that the variations are practically unproblematic, the cycle number may be used as the detection standard period.

The method of determining the fuel properties according to the sixteenth embodiment determines whether the heavy fuel is used, based on whether the Pm difference is greater than the threshold value α. When the Pm difference is greater than the threshold value α, the measure is taken that is required when the heavy fuel is used. The measures taken in the sixteenth embodiment is that the partial-cylinder operation is immediately stopped and fuel injection into the retarded start cylinder is started to immediately shift to the all-cylinder operation. By taking such a measure, the slowness of the increase in engine speed caused when a heavy fuel is used is resolved and it becomes possible to rapidly increase the engine speed to a target engine speed.

It is preferable that the method of determining the fuel properties and the measure required when the heavy fuel is used, which are employed in the sixteenth embodiment, be used in the retardative start control of the first embodiment. In addition, the feature of the sixteenth embodiment may be combined with the features of the other embodiments as appropriate in implementing the invention.

Although, in determining whether the heavy fuel is used, the focus is put on the behavior of the intake piping negative pressure in the sixteenth embodiment, whether the heavy fuel is used may be determined based on the behavior of the engine speed itself. Specifically, the integral value of the engine speed over the detection standard time t is calculated and the difference between the resultant integral value and the reference rotational speed integral value is calculated. The reference rotational speed integral value is the integral value of the engine speed over the detection standard time t when the model fuel is used, and a value determined in advance by the optimization is used as the reference rotational speed integral value. In this case, it suffices that the measure required when the heavy fuel is used is taken when the difference between the rotational speed integral value calculated and the reference rotational speed integral value exceeds a predetermined threshold value.

Seventeenth Embodiment

Figure 27:
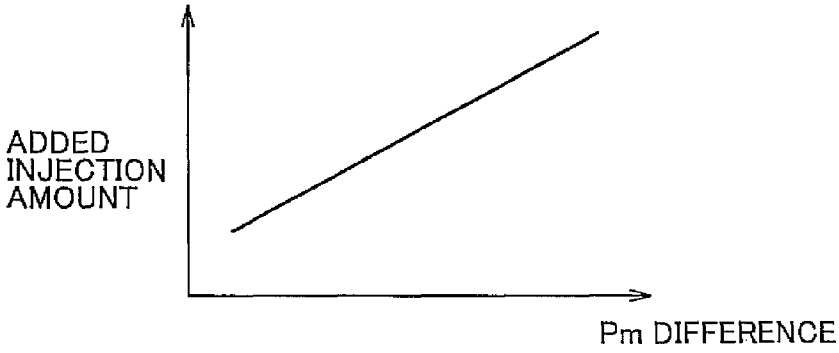
FIG. 27 is a diagram showing a map for determining, based on a difference between the intake piping negative pressure and a reference value thereof, the amount of increase of the amount of initial injection into the retarded start cylinder, which map is used in a controller of a seventeenth embodiment of the invention.
Figure 28:
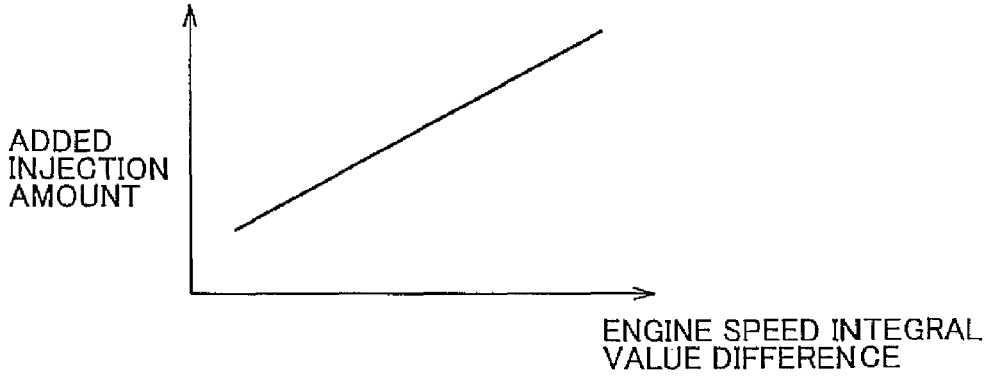
FIG. 28 is a diagram showing a map for determining, based on a difference between a rotational speed integral value and a reference value thereof, the amount of increase of the amount of initial injection into the retarded start cylinder, which map is used in the controller of the seventeenth embodiment of the invention.

Next, a seventeenth embodiment of the invention will be described with reference to FIGS. 27 to 29.

The controller of the seventeenth embodiment is used in the engine 1 configured as shown in FIG. 1 as in the case of the first embodiment. Thus, the following description will be made on the assumption that the engine shown in FIG. 1 is used, as in the case of the first embodiment. The controller of the seventeenth embodiment is implemented as part of functions of the electronic control unit 10 as in the cases of the other embodiments.

The seventeenth embodiment is a further improvement of the sixteenth embodiment. In the sixteenth embodiment, when the Pm difference is greater than the threshold value, the partial-cylinder operation is immediately stopped and fuel injection into the retarded start cylinder is started, with the aim of resolving the slowness of the increase in engine speed. However, when the heaviness of the fuel used is high, there is a possibility that the engine speed cannot be well increased even after the completion of transition to the all-cylinder operation. Thus, in the method used in the seventeenth embodiment, the fuel injection into the retarded start cylinder is immediately started and the fuel injection amount is increased according to the heaviness of the fuel used.

The heaviness of the fuel used can be determined based on the Pm difference, that is, the difference between the intake piping negative pressure Pm measured when the detection standard time t has elapsed since the ignition in the first combustion cylinder, and the reference Pmr of the model fuel. It can be said that the greater the Pm difference is, the higher the heaviness of the fuel used is. Thus, it is expected that by increasing the increment of the fuel injection amount in proportion to the Pm difference, rapid increase of the engine speed becomes possible.

In the seventeenth embodiment, an added injection amount that is the amount of fuel injection added to the fuel injection amount is determined from the Pm difference and the amount of the initial injection into the retarded start cylinder is corrected to increase by the determined increment. The increasing correction of the fuel injection amount (post start injection amount) of the normal start cylinder(s), in which combustion has already been started, is not performed. This is performed with the intention of preventing the engine speed from rapidly jumping up due to the rapid increase in torque. A map as shown in FIG. 27 is used to determine the added injection amount. In this map, the added injection amount is associated with the Pm difference and this map is set so that the greater the Pm difference is, the greater the added injection amount becomes.

Figures 29, 30:
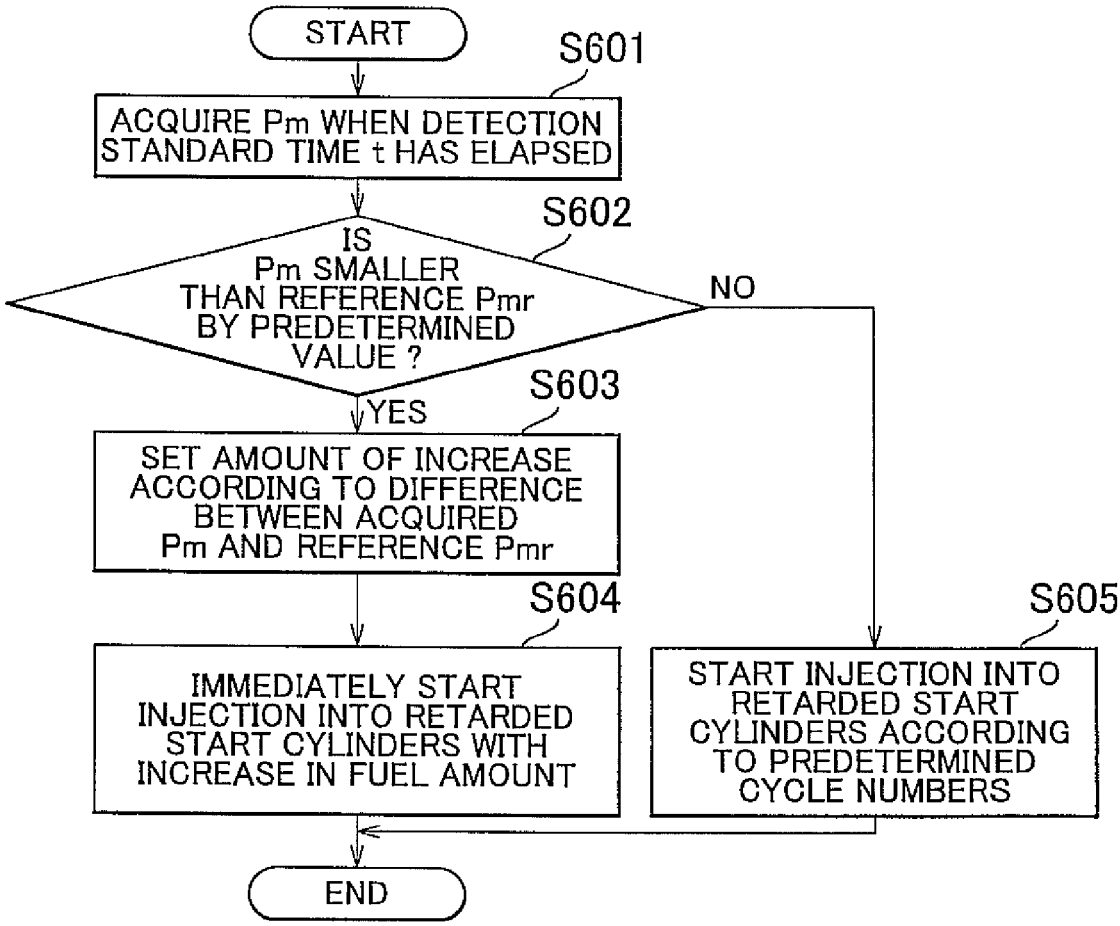
FIG. 29 is a flow chart showing a procedure of the retardative start control performed in the controller of the seventeenth embodiment of the invention.
FIG. 30 is a diagram showing a setting pattern of the retarded start cylinders according to a difference between the intake piping negative pressure and a reference value thereof, which setting pattern is used in a controller of an eighteenth embodiment of the invention.

FIG. 29 shows, in the form of a flow chart, the procedure in the case where the measure required when the heavy fuel is used as described above is used in the retardative start control. In the first step S601, the intake piping negative pressure Pm when the detection standard time t has elapsed since the ignition in the first combustion cylinder, is acquired. In the next step S602, the difference between the acquired intake piping negative pressure Pm and the reference Pmr is calculated and it is determined whether the difference exceeds the threshold value.

When the result of determination in step S602 is No, the process proceeds to step S605 and the ordinary, retardative start control is continued. Specifically, the fuel injection into the retarded start cylinders is started according to the retardated start cycle number determined in advance.

When the result of determination in step S602 is Yes, the process proceeds to step S603. In step S603, the added injection amount is set according to the difference between the intake piping negative pressure Pm and the reference Pmr. In the next step S604, the fuel injection into the retarded start cylinders, the amount of which is the initial injection amount that is increased by the added injection amount, is immediately started. In this way, it is ensured that the slowness of the increase in engine speed when the heavy fuel is used is resolved and it becomes possible to rapidly increase the engine speed to a target engine speed.

It is preferable that the measure required when the heavy fuel is used and taken in the seventeenth embodiment be used in combination with the retardative start control of the first embodiment. In addition, the feature of the seventeenth embodiment may be combined with the features of the other embodiments as appropriate in implementing the invention.

Although, in the seventeenth embodiment, the added injection amount to be added to the initial injection amount of the retarded start cylinder is determined based on the Pm difference, the added injection amount may be determined in another way. A method may be employed, in which the difference between the integral value of the engine speed over the detection standard time t and the reference rotational speed integral value corresponding to the model fuel is calculated and the added injection amount is determined from the difference (rotational speed integral value difference). A map as shown in FIG. 28 may be used to determine the added injection amount. In this map, the added injection amount is associated with the rotational speed integral value difference and this map is set so that the greater the rotational speed integral value difference is, the greater the added injection amount becomes.

Eighteenth Embodiment

Next, an eighteenth embodiment of the invention will be described with reference to FIGS. 30 and 31.

The controller of the eighteenth embodiment is used in the engine 1 configured as shown in FIG. 1 as in the case of the first embodiment. Thus, the following description will be made on the assumption that the engine shown in FIG. 1 is used, as in the case of the first embodiment. The controller of the eighteenth embodiment is implemented as part of functions of the electronic control unit 10 as in the cases of the other embodiments.

The eighteenth embodiment is a further improvement of the sixteenth embodiment and the seventeenth embodiment. In the sixteenth embodiment, when it is determined that the heaq fuel is used, the operation is immediately shifted to the all-cylinder operation to start the fuel injection into the retarded start cylinders, with the aim of increasing the engine speed. In the seventeenth embodiment, the initial fuel injection amount of the retarded start cylinders is increased according to the heaviness of the fuel used, which ensures the increase of the engine speed when the heavy fuel is used. However, starting the fuel injection into all the retarded start cylinders indiscriminately regardless of the heaviness of the fuel used can result in the occurrence of jumping up of the engine speed. As in the case where the increase of the engine speed is delayed, the jumping up of the engine speed is problematic in view of reduction of noise and vibrations. For this reason, used in the eighteenth embodiment is a method, in which instead of immediately shifting the operation to the all-cylinder operation, the setting of the retarded start cylinder(s) is changed according to the heaviness of the fuel used.

As described above, the heaviness of the fuel used can be determined based on the difference (Pm difference) between the intake piping negative pressure Pm measured when the detection standard time t has elapsed since the ignition in the first combustion cylinder and the reference Pmr of the model fuel. When the Pm difference is too large, as in the cases of the sixteenth embodiment and the seventeenth embodiment, the slowness of the increase in engine speed is not resolved unless the fuel injection is immediately started for all the retarded start cylinders. However, it is considered that, when the Pm difference is not so large, starting the fuel injection into part of the retarded start cylinders suffices to increase the engine speed.

FIG. 30 is a diagram showing an example of a setting pattern of the retarded start cylinders according to the Pm difference. In the eighteenth embodiment, the setting of the retarded start cylinders during the partial-cylinder operation is changed depending on the Pm difference according to the setting pattern as shown in FIG. 30. In this table, the cylinder marked with a circle is the firing cylinder, and the cylinder marked with a cross is the stop cylinder, that is, the retarded start cylinder. According to the example shown in FIG. 30, when the Pm difference (unit is kPa) is from 0 to 15, the second cylinder (#2), the fourth cylinder (#4), the sixth cylinder (#6), and the eight cylinder (#8) in the firing order are set as the retarded start cylinders. That is, the initial setting of the retarded start cylinders in the partial-cylinder operation is kept unchanged. When the Pm difference is from 15 to 30, the fuel injection into the second cylinder is started and the number of stop cylinders is changed to three. When the Pm difference is from 30 to 45, the fuel injection into the fourth cylinder is started and the number of stop cylinders is changed to two. When the Pm difference is from 45 to 60, the fuel injection into the sixth cylinder is started and the number of stop cylinders is changed to one. When the Pm difference exceeds 60, the fuel injection into the eighth cylinder is started and the operation is shifted to the all-cylinder operation. It should be noted that the setting pattern as shown in FIG. 30 is merely an example and the actual relation between the Pm difference and the number of stop cylinders is determined by optimization.

Figure 31:
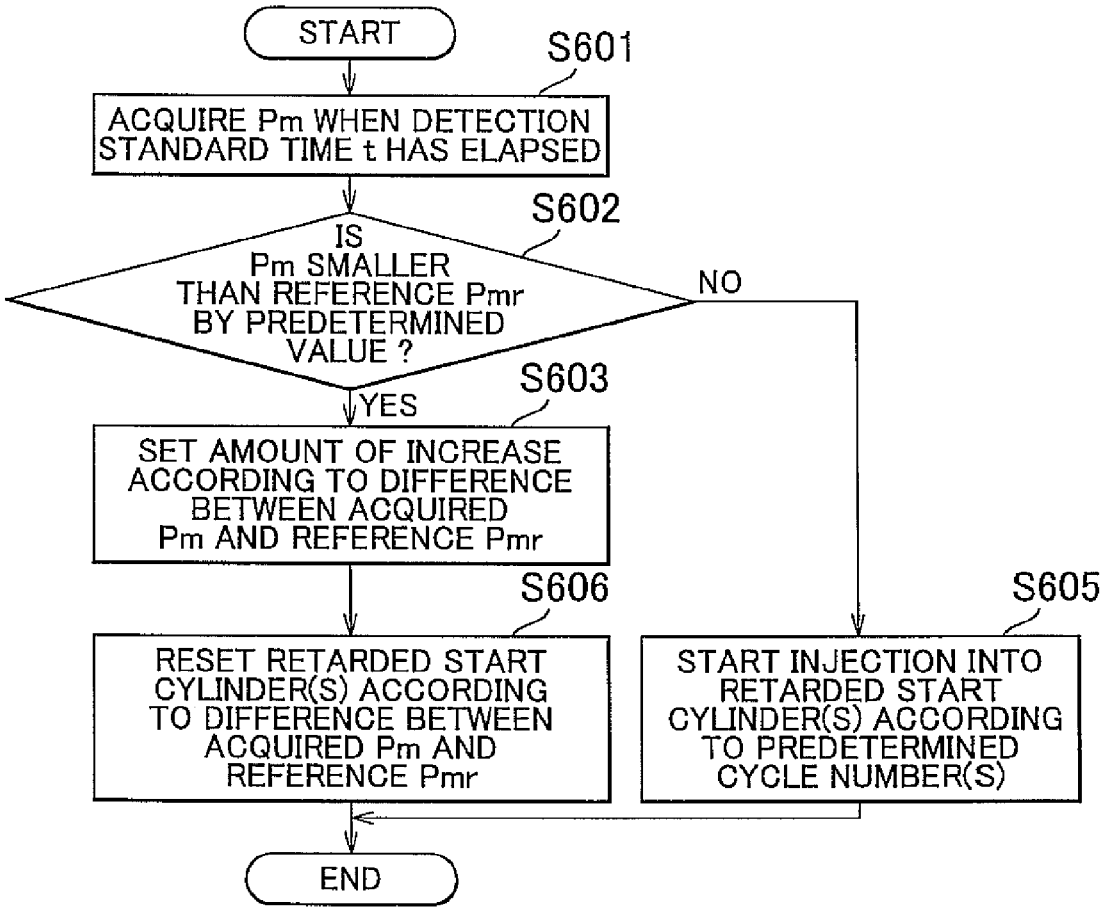
FIG. 31 is a flow chart showing a procedure of the retardative start control performed in the controller of the eighteenth embodiment of the invention.

FIG. 31 shows, in the form of a flow chart, the procedure in the case where the measure required when the heavy fuel is used as described above is used in the retardative start control. In the first step S601, the intake piping negative pressure Pm when the detection standard time t has elapsed since the ignition in the first combustion cylinder, is acquired. In the next step S602, the difference between the acquired intake piping negative pressure Pm and the reference Pmr is calculated and it is determined whether the difference exceeds the threshold value. According to the example shown in FIG. 30, the threshold value of the Pm difference used in this case is 15 kPa.

When the result of determination in step S602 is No, the process proceeds to step S605 and the ordinary, retardative start control is continued. Specifically, the fuel injection into the retarded start cylinders is started according to the retardated start cycle number determined in advance.

When the result of determination in step S602 is Yes, the process proceeds to step S603. In step S603, the added injection amount is set according to the difference between the intake piping negative pressure Pm and the reference Pmr. In the next step S606, the retarded start cylinder(s) is/are reset according to the difference between the intake piping negative pressure Pm and the reference Pmr. In this way, it is ensured that the slowness of the increase in engine speed when the heavy fuel is used is resolved and it becomes possible to prevent the engine speed from excessively jumping up.

It is preferable that the measure required when the heavy fuel is used and taken in the eighteenth embodiment be used in combination with the retardative start control of the first embodiment. In addition, the feature of the eighteenth embodiment may be combined with the features of the other embodiments as appropriate in implementing the invention.

Although, in the eighteenth embodiment, the setting of the retarded start cylinders is changed according to the Pm difference, another method may be employed. The difference between the integral value of the engine speed over the detection standard time t and the reference rotational speed integral value corresponding to the model fuel may be calculated and the setting of the retarded start cylinder(s) may be changed according to the difference (rotational speed integral value difference).

Nineteenth Embodiment

Next, a nineteenth embodiment of the invention will be described with reference to FIGS. 32 and 33.

A feature of the nineteenth embodiment is that the cylinder(s) set as the retarded start cylinder(s) is/are optimized according to the configuration of the exhaust system of the engine. FIG. 32 shows an example of the configuration of the exhaust system in a V-type 8-cylinder engine. The symbols from #1 to #8 shown in FIG. 32 are the unique cylinder numbers assigned to the cylinders. In the example shown in FIG. 32, in the left bank, an exhaust manifold 30A is connected to the first cylinder and the third cylinder that are positioned far from a catalyst 31A, and an exhaust manifold 30B is connected to the fifth cylinder and the seventh cylinder that are positioned near the catalyst 31A. The two exhaust manifolds 30A and 30B are connected to the catalyst 31A in parallel. In the right bank, an exhaust manifold 30C is connected to the second cylinder and the fourth cylinder that are positioned far from the catalyst 31B, and an exhaust manifold 30D is connected to the sixth cylinder and the eighth cylinder that are positioned near the catalyst 31B. The two exhaust manifolds 30C and 30D are connected to the catalyst 31B in parallel.

It is a conceivable example of the setting of the retarded start cylinder(s) in the V-type 8-cylinder engine that the retarded start cylinders and the normal start cylinders are alternately arranged. The cylinders hatched in the drawings are the normal start cylinders and the cylinders not hatched are the retarded start cylinders. In the example shown in FIG. 32, the first, the second, the fifth, and the sixth cylinders are set as the normal start cylinders. The remaining cylinders, that is, the third, the fourth, the seventh, and the eighth cylinders are set as the retarded start cylinders. In such setting, however, there is a problem in view of the ease of warming up the catalysts 31A and 31B.

In the normal start cylinders, in which firing is performed from the beginning of the start-up, the amount of thermal energy discharged is large as compared to that in the retarded start cylinders, in which firing is started later. This is because the intake piping negative pressure at the time of first combustion in the normal start cylinder is close to the atmospheric pressure and therefore, the load factor naturally becomes high. In order to quickly warm up the catalyst, it is desired to supply, to the catalyst, the large amount of thermal energy discharged from the normal start cylinder(s) during the start-up time, with minimum waste. However, in the setting shown in FIG. 32, of the normal start cylinders, the first and second cylinders are positioned the farthest from the catalyst. Thus, the surface area of the exhaust passage from each of the first and second cylinders to the catalyst is larger than that of the exhaust passage from any other cylinder and therefore, the amount of thermal energy lost by the dissipation through the wall surface becomes correspondingly large. In addition, in the setting shown in FIG. 32, a normal start cylinder and a retarded start cylinder are paired and connected to the common exhaust passage. Thus, when the air discharged from the retarded start cylinders passes through the exhaust passages, the thermal energy that the exhaust passages receive from the combustion gas discharged from the normal start cylinder(s) is taken away by low-temperature air.

Figure 32:
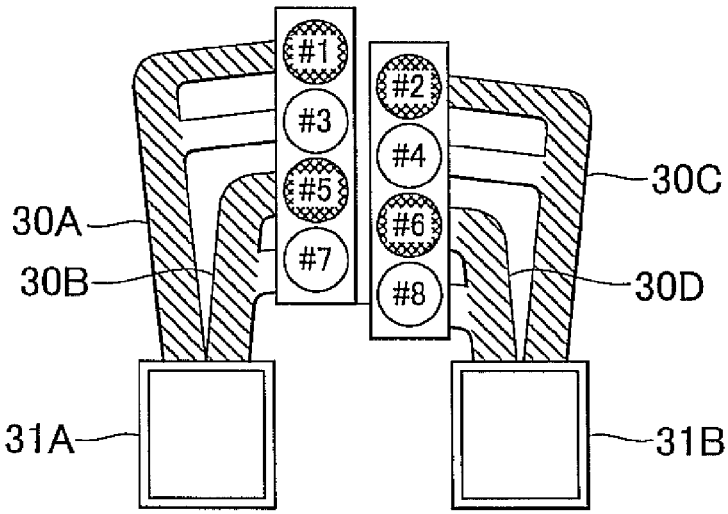
FIG. 32 is a diagram showing an example of setting of the retarded start cylinders in a multi-cylinder internal combustion engine.

From the reasons as described above, when the setting of the retarded start cylinders as described in FIG. 32 is employed, the ease of warming up the catalysts 31A and 31B is inferior and the catalysts 31A and 31B cannot be quickly activated. Thus, in the nineteenth embodiment, the cylinders, the exhaust passages of which have a relatively small surface area between the cylinders and the catalysts, are set as the normal start cylinders, and the cylinders, the exhaust passages of which have a relatively large surface area between the cylinders and the catalysts, are set as the retarded start cylinders. FIG. 33 shows the setting of the retarded start cylinders in the case of the nineteenth embodiment. The cylinders hatched in the drawing are the normal start cylinders and the cylinders not hatched are the retarded start cylinders. In FIG. 33, the fifth, the sixth, the seventh, and the eighth cylinders, which are positioned near the catalysts 31A and 31B, are set as the normal start cylinders, and the first, the second, the third, and the fourth cylinders, which are positioned far from the catalysts 31A and 31B are set as the retarded start cylinders. When such setting is employed, the total surface area from the normal start cylinders to the catalysts is minimized and the efficiency in transferring the thermal energy of exhaust gas to the catalysts 31A and 31B is increased. In addition, because the fifth and seventh cylinders, which share the exhaust manifold 30B, are set as the normal start cylinders and the sixth and eighth cylinders, which share the exhaust manifold 30D, are set as the normal start cylinders, there is also an advantage that the thermal energy is prevented from being taken away by the air discharged from the retarded start cylinders.

Figure 33:
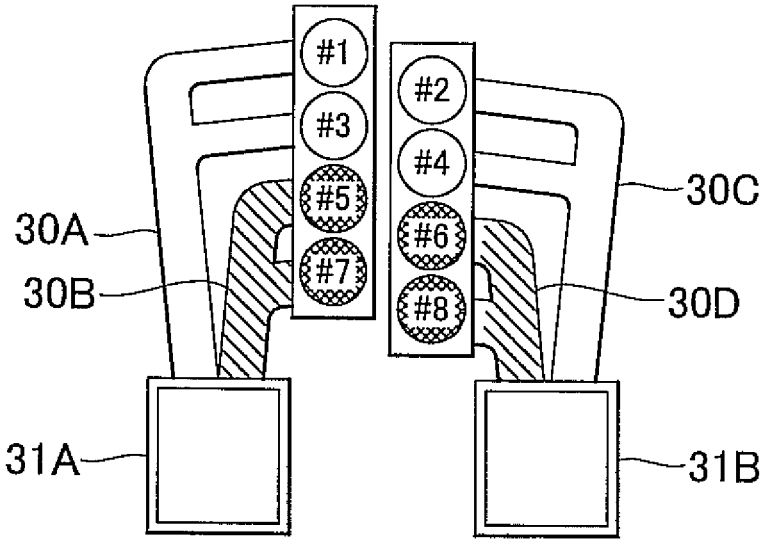
FIG. 33 is a diagram showing a setting of the retarded start cylinders in the multi-cylinder internal combustion engine according to a nineteenth embodiment of the invention.

The setting that is inverse to the setting shown in FIG. 33, that is, the setting, in which the fifth, the sixth, the seventh, and the eighth cylinders are set as the retarded start cylinders and in which the first, the second, the third, and the fourth cylinders are set as the normal start cylinders, also brings about a certain level of advantageous effect. Although this case is disadvantageous in that the normal start cylinders are positioned far from the catalysts 31A and 31B, an effect similar to that achieved by employing the setting as shown in FIG. 33 is achieved in terms of the fact that the thermal energy is prevented from being taken away by the air discharged from the retarded start cylinders.

Twentieth Embodiment

Figure 34:
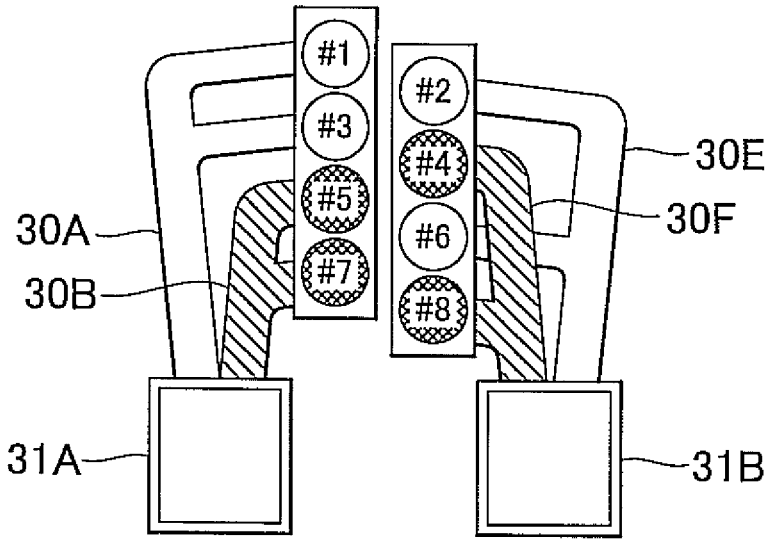
FIG. 34 is a diagram showing a setting of the retarded start cylinders in a multi-cylinder internal combustion engine according to a twentieth embodiment of the invention.

Next, a twentieth embodiment of the invention will be described with reference to FIG. 34.

As in the case of the nineteenth embodiment, a feature of the twentieth embodiment is that the cylinder(s) set as the retarded start cylinder(s) is/are optimized according to the configuration of the exhaust system of the engine. FIG. 34 shows a configuration of the exhaust system in a V-type 8-cylinder engine of the twentieth embodiment and the setting of the retarded start cylinders optimized accordingly. The cylinders hatched in the drawing are the normal start cylinders and the cylinders not hatched are the retarded start cylinders.

The engine of the twentieth embodiment is the same as that of the nineteenth embodiment in the configuration of the exhaust system of the left bank but differs therefrom in the configuration of the exhaust system of the right bank. In the right bank, the exhaust manifold 30E is connected to the second cylinder that is positioned the farthest from the catalyst 31B and the sixth cylinder that is positioned the third farthest from the catalyst 31B, and the exhaust manifold 30F is connected to the eighth cylinder that is positioned the nearest to the catalyst 31B and the fourth cylinder that is the third nearest to the catalyst 31B. The two exhaust manifolds 30E and 30F are connected to the catalyst 31B in parallel. In the setting as shown in FIG. 34, in the right bank, the cylinders that are set as the normal start cylinders are the fourth and eighth cylinders that are connected to the exhaust manifold 30F, and the cylinders that are set as the retarded start cylinders are the second and sixth cylinders that are connected to the exhaust manifold 30E. Because the exhaust manifold 30F has a pipe length that is shorter than that of the exhaust manifold 30E, it is possible to increase the efficiency in transferring the discharged thermal energy to the catalysts 31A and 31B by setting the fourth and eighth cylinders as the normal start cylinders. In addition, by connecting the normal start cylinders to the same exhaust manifold 30F, an advantageous effect is brought about that the thermal energy is prevented from being taken away by the air discharged from the retarded start cylinders.

Twenty-First Embodiment

Figure 35:
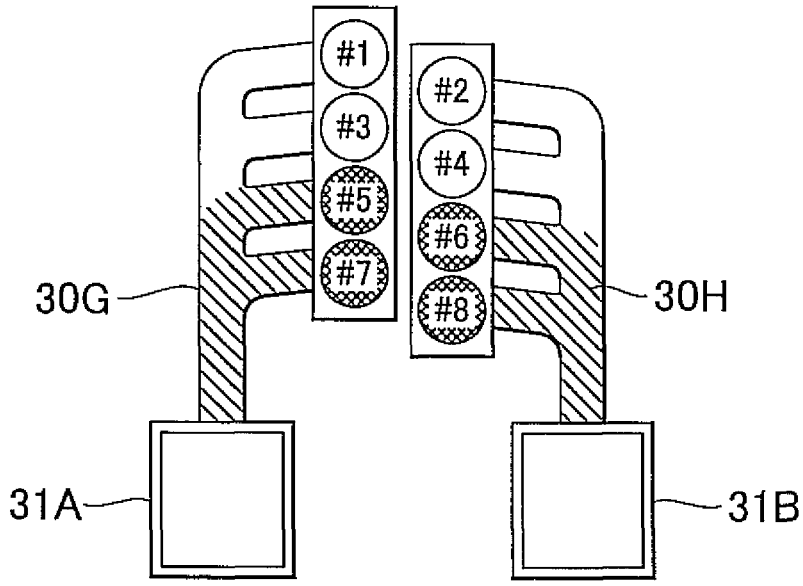
FIG. 35 is a diagram showing a setting of the retarded start cylinders in a multi-cylinder internal combustion engine according to a twenty-first embodiment of the invention.

Next, a twenty-first embodiment of the invention will be described with reference to FIG. 35.

As in the cases of the nineteenth and twentieth embodiments, a feature of the twenty-first embodiment is that the cylinder(s) set as the retarded start cylinder(s) is/are optimized according to the configuration of the exhaust system of the engine. FIG. 35 shows a configuration of the exhaust system in a V-type 8-cylinder engine of the twenty-first embodiment and the setting of the retarded start cylinders optimized accordingly. The cylinders hatched in the drawing are the normal start cylinders and the cylinders not hatched are the retarded start cylinders.

The engine of the twenty-first embodiment is provided with exhaust manifolds 30G and 30H for respective banks. In such a configuration of the exhaust system, it is impossible to separate the exhaust passage for the normal start cylinders from the exhaust passage for the retarded start cylinders as in the cases of the nineteenth and twentieth embodiment. In this case, as described in the description of the nineteenth embodiment, the fifth, the sixth, the seventh, and the eighth cylinders, which are positioned near the catalysts 31A and 31B, are set as the normal start cylinders, and the first, the second, the third, and the fourth cylinders that are positioned far from the catalysts 31A and 31B are set as the retarded start cylinders. In other words, the retarded start cylinders are set so that the total surface area from the normal start cylinders to the catalysts is minimized. By so doing, it is possible to increase the efficiency in transferring the discharged thermal energy to the catalysts 31A and 31B to quickly activate the catalysts 31A and 31B.

Twenty-Second Embodiment

Figure 36:
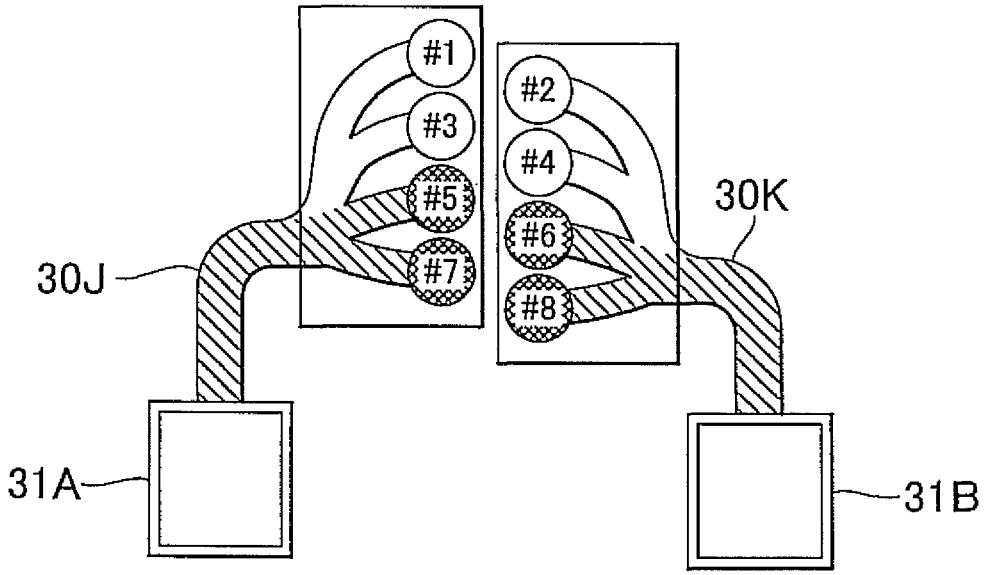
FIG. 36 is a diagram showing a setting of the retarded start cylinders in a multi-cylinder internal combustion engine according to a twenty-second embodiment of the invention.

Next, a twenty-second embodiment of the invention will be described with reference to FIG. 36.

As in the cases of the nineteenth, twentieth, and twenty-first embodiments, a feature of the twenty-second embodiment is that the cylinder(s) set as the retarded start cylinder(s) is/are optimized according to the configuration of the exhaust system of the engine. FIG. 36 shows a configuration of the exhaust system in a V-type 8-cylinder engine of the twenty-second embodiment and the setting of the retarded start cylinders optimized accordingly. The cylinders hatched in the drawing are the normal start cylinders and the cylinders not hatched are the retarded start cylinders.

In the engine of the twenty-second embodiment, the exhaust manifolds are incorporated in the cylinder heads of the respective banks. Exhaust passages 30J and 30K are connected to these banks. In this case, as in the case of the twenty-first embodiment, the fifth, the sixth, the seventh, and the eighth cylinders, which are close to the catalysts 31A and 31B, are set as the normal start cylinders, and the first, the second, the third, and the fourth cylinders, which are far from the catalysts 31A and 31B, are set as the retarded start cylinders. According to such setting, even in the case of an engine provided with the exhaust manifolds incorporated in the cylinder heads, it is possible to increase the efficiency in transferring the discharged thermal energy to the catalysts 31A and 31B to quickly activate the catalysts 31A and 31B.

Twenty-Third Embodiment

Figure 37:
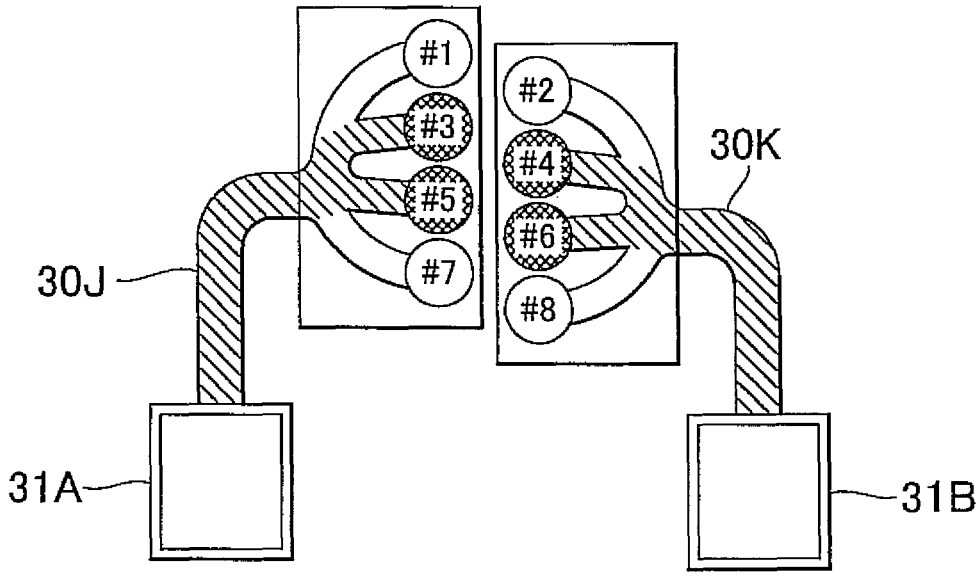
FIG. 37 is a diagram showing a setting of the retarded start cylinders in a multi-cylinder internal combustion engine according to a twenty-third embodiment of the invention.

Next, a twenty-third embodiment of the invention will be described with reference to FIG. 37.

As in the cases of the nineteenth, twentieth, twenty-first, and twenty-second embodiments, a feature of the twenty-third embodiment is that the cylinder(s) set as the retarded start cylinder(s) is/are optimized according to the configuration of the exhaust system of the engine. FIG. 37 shows a configuration of the exhaust system in a V-type 8-cylinder engine of the twenty-third embodiment and the setting of the retarded start cylinders optimized accordingly. The cylinders hatched in the drawing are the normal start cylinders and the cylinders not hatched are the retarded start cylinders.

In the engine of the twenty-third embodiment, as in the case of the twenty-second embodiment, the exhaust manifolds are incorporated in the cylinder heads of the respective banks. Exhaust passages 30J and 30K are connected to these banks. The engine of the twenty-third embodiment and the engine of the twenty-second differ from each other in the arrangement of the exhaust manifolds in the cylinder heads. Also in this case, however, the setting of the retarded start cylinders may be determined in view of the distances from the catalysts 31A and 31B. Specifically, the third, the fourth, the fifth, and the sixth cylinders, which are close to the catalysts 31A and 31B, may be set as the normal start cylinders, and the first, the second, the seventh, and the eighth cylinders, which are far from the catalysts 31A and 31B, may be set as the retarded start cylinders.

As described above, the nineteenth to twenty-third embodiments are all characterized in the configuration of the exhaust system of the engine and the setting of the retarded start cylinders according to this configuration. These features can be combined with the retardative start control of the first embodiment. In addition, these embodiments may be combined with the other embodiments as appropriate. Because the nineteenth to twenty-third embodiments make it possible to quickly activate the catalysts 31A and 31B, it is possible to more effectively suppress the discharge of unburned HC to the outside of the system by combining the nineteenth to twenty-third embodiments with the first to eighteenth embodiments as appropriate.

Other Embodiments

While the embodiments of the invention have been described above, the invention is not limited to the above-described embodiments but can be implemented in various modifications within the scope of the invention. For example, although the intake piping pressure used in the retardative start control is measured by the intake piping pressure sensor 20 in the above-described embodiments, the intake piping pressure may be estimated based on the engine speed and the engine load and the estimated value may be used to perform the retardative start control.

In the above description of the embodiments, the V-type 8-cylinder engine is taken as an example for illustration, the invention can be applied, without problems, to a multi-cylinder engine capable of performing the partial-cylinder operation.

In the internal combustion engine controller of the first aspect, a configuration may be employed, in which, when the number of the remaining cylinders is equal to or greater than two, the fuel supply starting section sets a retarded start cycle number for one of the retarded start cylinders that differs from a retarded start cycle number for another of the retarded start cylinders, the retarded start cycle number being the number of cycles, by which start of the fuel supply is retarded, that is, the number of cycles, in which the fuel supply is stopped in the corresponding retarded start cylinder.

With the above configuration, it is possible to suppress jumping up of the engine speed that is caused during the transition from the partial-cylinder operation to the all-cylinder operation.

The internal combustion engine controller of the first aspect may further include a jumping-up detecting device that detects jumping up of the rotational speed of the internal combustion engine, wherein the fuel supply starting section increases the retarded start cycle number of at least one of the remaining cylinders when the jumping-up detecting device detects the jumping up.

With the above configuration, it is possible to suppress the jumping up of the engine speed that occurs during the transition from the partial-cylinder operation to the all-cylinder operation, after the occurrence of the jumping up.

The internal combustion engine controller of the first aspect may further include a small opening degree setting section that, until starting supplying fuel into the at least one remaining cylinder, sets the degree of opening of a throttle valve that is disposed in the intake piping smaller than the degree of opening of the throttle valve, at which the amount of air taken into the cylinders through the intake piping and the amount of air that passes through the throttle valve balance.

With the above configuration, the degree of opening of the throttle valve is set smaller than the degree of opening of the throttle valve, at which the amount of air taken into the cylinders through the intake piping and the amount of air that passes through the throttle valve balance, so that the amount of air flowing into the cylinders through the intake piping becomes greater than the amount of air that passes through the throttle valve into the intake piping. As a result, the magnitude of the intake piping negative pressure increases at a speed higher than ordinary speeds. In the internal combustion engine controller with the above configuration, until starting supplying fuel into the remaining cylinder, into which fuel supply is not performed at the time of starting the engine, such control of the degree of opening of the throttle valve is performed. Thus, the time taken for the magnitude of the intake piping negative pressure to exceed the reference value, is reduced, so that the start time of the fuel supply into the remaining cylinder(s) is advanced. When the fuel supply into the remaining cylinder(s) is started, the thermal energy that flows into the exhaust passage is increased and the activation of the catalyst disposed in the exhaust passage is promoted. For this reason, with the above configuration, it is possible to suppress the discharge of unburned HC from the internal combustion engine body into the exhaust passage and at the same time, to quickly activate the catalyst disposed in the exhaust passage. Moreover, it is possible to effectively suppress the discharge of unburned HC to the outside of the system by quickly activating the catalyst.

The internal combustion engine controller of the first aspect may further include a negative pressure increasing system that, after the starting section starts the internal combustion engine, actively increases the negative pressure produced in the intake piping.

With the above configuration, it becomes possible to quickly activate the catalyst disposed in the exhaust passage and thus, it is possible to more effectively suppress the discharge of unburned HC to the outside of the system.

In the internal combustion engine controller of the first aspect, a configuration may be employed, in which the negative pressure increasing system brings a throttle valve disposed in the intake piping into a small opening state, in which the degree of opening of the throttle valve is set to a degree smaller than is determined based on the amount of air required to run the internal combustion engine, to actively increase the negative pressure and when the rotational speed of the internal combustion engine exceeds a predetermined guard value, the negative pressure increasing system releases the throttle valve from the small opening state.

With the above configuration, it becomes possible to quickly activate the catalyst disposed in the exhaust passage and thus, it is possible to more effectively suppress the discharge of unburned HC to the outside of the system.

In the internal combustion engine controller of the first aspect, the small opening state may be a state where the throttle valve is fully closed.

With the above configuration, it becomes possible to quickly activate the catalyst disposed in the exhaust passage and thus, it is possible to more effectively suppress the discharge of unburned HC to the outside of the system.

In the internal combustion engine controller of the first aspect, a configuration may be employed, in which the negative pressure increasing system includes a variable intake length system and fixes the length of the intake piping so as to be minimized by the variable intake length system to actively increase the negative pressure and when a rotational speed of the internal combustion engine exceeds a predetermined guard value, the negative pressure increasing system quits fixing the length of the intake piping.

With the above configuration, it becomes possible to quickly activate the catalyst disposed in the exhaust passage and thus, it is possible to more effectively suppress the discharge of unburned HC to the outside of the system.

The internal combustion engine controller of the first aspect may further include a torque reduction suppression section that, after the starting section starts the internal combustion engine, suppresses reduction in the torque produced by the internal combustion engine to help increase a rotational speed of the internal combustion engine until the negative pressure exceeds the predetermined reference value.

With the above configuration, it is possible to suppress the discharge of unburned HC that accompanies the start of the internal combustion engine. In addition, it is ensured that the engine speed is reliably increased.

In the internal combustion engine controller of the first aspect, a configuration may be employed, in which the internal combustion engine includes a variable valve timing (VVT) system and an exhaust gas recirculation (EGR) system, and the torque reduction suppression section inhibits operation of the VVT system to suppress the reduction in the torque.

With the above configuration, it is possible to suppress the discharge of unburned HC that accompanies the start of the internal combustion engine. In addition, it is ensured that the engine speed is reliably increased.

In the internal combustion engine controller of the first aspect, the torque reduction suppression section may inhibit supply of power to at least one external load to suppress the reduction in the torque.

With the above configuration, it is possible to suppress the discharge of unburned HC that accompanies the start of the internal combustion engine. In addition, it is ensured that the engine speed is reliably increased.

The internal combustion-engine controller of the first aspect may further include a torque reducing section that, when the fuel supply into the remaining cylinder is started, reduces a torque produced by the remaining cylinder, into which the fuel supply is to be started.

With the above configuration, when the fuel supply into the remaining cylinder(s), into which fuel supply is not performed at the time of starting the engine, is started, the torque produced by the remaining cylinder(s), into which the fuel supply is to be started, is reduced. Thus, it is possible to suppress the occurrence of the torque shock that accompanies the start of combustion in the remaining cylinder(s) and as a result, it is possible to prevent the jumping up of the rotational speed. Examples of the method of reducing the torque produced by the cylinder(s) include reducing the intake air amount of the remaining cylinder(s), increasing the internal EGR amount of the remaining cylinder(s), and increasing the external EGR amount of the remaining cylinder(s).

The internal combustion engine controller of the first aspect may further include a leaning section that, before the fuel supply into the remaining cylinder is started, makes an air-fuel ratio of a mixture that is supplied to the part of the plurality of cylinders leaner than a stoichiometric air-fuel ratio by reducing the amount of fuel supply.

With the above configuration, before the fuel supply into the remaining cylinder, into which fuel supply is not performed at the time of starting the internal combustion engine, is started, an air-fuel ratio of a mixture that is supplied to the part of the plurality of cylinders, into which fuel supply is performed from the beginning, is made leaner than a stoichiometric air-fuel ratio by reducing the amount of fuel supply. In the remaining cylinder(s), into which fuel supply is not performed at the time of starting the internal combustion engine, the temperature of the cylinder wall surfaces and the temperature of the neighboring portions thereof are low and therefore, combustion is unstable and it is difficult to perform the lean burn operation. On the other hand, in the cylinder(s), in which fuel supply is performed from the beginning, the cylinder wall surfaces and the neighboring portions thereof have been warmed up and the combustion therein is therefore stable, so that the lean burn operation is possible. With the above configuration, lean burn operation is performed in the cylinders, in which combustion has been started, to reduce the produced torque, so that it is possible to prevent the jumping up of the engine speed that accompanies the start of combustion in the remaining cylinder(s).

In the internal combustion engine controller of the first aspect, the starting section may always consecutively perform the fuel supply into the cylinder that is next in firing order of the cylinders to the cylinder, in which the fuel supply is performed first.

With the above configuration, when the cylinder, into which fuel supply is performed first in firing order of the cylinders, is determined, the cylinder that is next in firing order to the cylinder is always selected as one of "the part of cylinders", into which fuel supply is performed from the beginning. In this way, even when the torque produced in the cylinder, in which fuel supply is performed first, is insufficient, the rotation during start-up is assisted by the torque produced by the consecutive, next cylinder, so that it is possible to increase the robustness of the start-up operation.

The internal combustion engine controller of the first aspect may further include a correction section that corrects a control parameter related to combustion conditions in the cylinder to be fired according to a rotational speed of the internal combustion engine while any one of the remaining cylinders is in an expansion stroke and the degree of decrease in the rotational speed.

With the above configuration, a rotational speed of the internal combustion engine while any one of the cylinders, into which fuel supply is not being performed, is in an expansion stroke and the degree of decrease in the rotational speed are acquired and according to the rotational speed and the degree of decrease therein, the control parameter related to combustion conditions in the cylinder to be fired is corrected. The rotational speed of the internal combustion engine is determined by combustion conditions and friction and therefore, the combustion conditions cannot be correctly determined based only on the rotational speed. However, by referring also to the degree of decrease in the rotational speed while the internal combustion engine is coasting, it is possible to determine the magnitude of the friction occurring in the internal combustion engine, so that it is possible to accurately determine the combustion conditions. Thus, with the above configuration, it is possible to correct the control parameter related to combustion conditions in the cylinder to be fired so that optimum combustion conditions can be obtained and therefore, it is possible to ensure good startability. Examples of the control parameters related to the combustion conditions include a fuel supply amount during a start-up time, a fuel supply amount after the start-up time, a fuel supply timing after the start-up time, and an intake air amount, for example.

In the internal combustion engine controller of the first aspect, the starting section may change the number of cylinders, into which the fuel supply is performed, according to the magnitude of the negative pressure in the intake piping at a predetermined time point after rotational speed increases due to the initial combustion.

With the above configuration, when the internal combustion engine is started by performing fuel supply into part of the cylinders, the magnitude of the intake piping negative pressure at a predetermined time point after rotational speed increases due to the initial combustion, is acquired, and the number of cylinders, into which the fuel supply is performed, is changed according to the magnitude of the intake piping negative pressure. This is a process intended to obtain a certain level of startability regardless of the fuel properties. The rotational speed at the time of starting the internal combustion engine affects the occurrence of noise and vibrations and when the rotational speed is too low, problems of noise and vibrations occur. The rotational speed depends on the properties of the fuel being used. The greater the amount of heavy components contained in the fuel is, the lower the degree of increase in the rotational speed during start-up is. In addition, the degree of increase in the rotational speed at the time of starting the internal combustion engine is reflected on the magnitude of the intake piping negative pressure. The greater the amount of heavy components of the fuel is, the lower the magnitude of the intake piping negative pressure is. Thus, by measuring the intake piping negative pressure and comparing the magnitude thereof with a reference value, it is possible to determine the properties of the fuel being used. Based on the determination result, it is possible to set the number of cylinders, into which fuel supply is performed at the time of starting the internal combustion engine, according to the fuel properties. For example, when the degree of increase in the rotational speed is low because of the influence of the use of the heavy fuel and the magnitude of the intake piping negative pressure is low, it is possible to increase the rotational speed by increasing the number of cylinders, into which fuel supply is performed at the time of starting the internal combustion engine and therefore, it is possible to prevent the occurrence of noise and vibrations.

In the internal combustion engine controller of the first aspect, the lower the magnitude of the negative pressure in the intake piping at the predetermined time point after the rotational speed increases due to the initial combustion is, the greater number the starting section may set the number of the cylinders, into which the fuel supply is performed when the starting section starts the internal combustion engine, to.

With the above configuration, it is ensured that the slowness of the increase in engine speed when the heavy fuel is used is resolved and it is also possible to prevent extreme jumping up of the engine speed.

In the internal combustion engine controller of the first aspect, the starting section may perform the fuel supply into the cylinders, exhaust passages of which have a relatively small surface area between these cylinders to a catalyst, the cylinders being part of the plurality of cylinders.

With the above configuration, when the internal combustion engine is started by performing fuel supply into part of the cylinders, the fuel supply into the cylinders, exhaust passages of which have a relatively small surface area between these cylinders and a catalyst, is performed. When the surface area of the exhaust passages between these cylinders and a catalyst is small, the exhaust-gas thermal energy discharged through the surfaces of the exhaust passages to the outside of the system is small. Thus, with the above configuration, it is possible to increase the efficiency in transferring the exhaust-gas thermal energy to the catalyst and it is therefore possible to quickly activate the catalyst. By quickly activating the catalyst, it is possible to effectively suppress the discharge of unburned HC to the outside of the system.

What is claimed is:

1. An internal combustion engine controller comprising:

a starting section that starts an internal combustion engine by performing fuel supply into part of a plurality of cylinders included in the internal combustion engine;

a fuel supply starting section that starts fuel supply into at least one remaining cylinder of the plurality of cylinders after a magnitude of a negative pressure produced in intake piping of the internal combustion engine exceeds a predetermined reference value; and a jumping-up detecting device that detects jumping up of a rotational speed of the internal combustion engine;

wherein the starting section performs fuel supply into part of the plurality of cylinders in the internal combustion engine before the magnitude of the negative pressure produced in the intake piping of the internal combustion engine exceeds the predetermined reference value, when a number of the remaining cylinders is equal to or greater than two, the fuel supply starting section sets a retarded start cycle number for one of the retarded start cylinders that differs from a retarded start cycle number for another of the retarded start cylinders, the retarded start cycle number being a number of cycles, by which start of the fuel supply is retarded, that is, a number of cycles, in which the fuel supply is stopped in the corresponding retarded start cylinder;

wherein the fuel supply starting section increases the retarded start cycle number of at least one of the remaining cylinders when the jumping-up detecting device detects the jumping up.

2. The internal combustion engine controller according to claim 1, further comprising a small opening degree setting section that, until starting supplying fuel into the at least one remaining cylinder, sets a degree of opening of a throttle valve that is disposed in the intake piping smaller than a degree of opening of the throttle valve, at which an amount of air taken into the cylinders through the intake piping and an amount of air that passes through the throttle valve balance.

3. The internal combustion engine controller according to claim 1, further comprising a negative pressure increasing system that, after the starting section starts the internal combustion engine, actively increases the negative pressure produced in the intake piping.

4. The internal combustion engine controller according to claim 3, wherein the negative pressure increasing system brings a throttle valve disposed in the intake piping into a small opening state, in which the degree of opening of the throttle valve is set to a degree smaller than is determined based on an amount of air required to run the internal combustion engine, to actively increase the negative pressure and when a rotational speed of the internal combustion engine exceeds a predetermined guard value, the negative pressure increasing system releases the throttle valve from the small opening state.

5. The internal combustion engine controller according to claim 4, wherein the small opening state is a state where the throttle valve is fully closed.

6. The internal combustion engine controller according to claim 3, wherein the negative pressure increasing system includes a variable intake length system and fixes a length of the intake piping so as to be minimized by the variable intake length system to actively increase the negative pressure and when a rotational speed of the internal combustion engine exceeds a predetermined guard value, the negative pressure increasing system quits fixing the length of the intake piping.

7. The internal combustion engine controller according to claim 1, further comprising a torque reduction suppression section that, after the starting section starts the internal combustion engine, suppresses reduction in the torque produced by the internal combustion engine to help increase a rotational speed of the internal combustion engine until the negative pressure exceeds the predetermined reference value.

8. The internal combustion engine controller according to claim 7, wherein the internal combustion engine includes a variable valve timing (VVT) system and an exhaust gas recirculation (EGR) system, and the torque reduction suppression section inhibits operation of the VVT system to suppress the reduction in the torque, the VVT system varies a timing of at least one of intake valves or exhaust valves of the internal combustion engine.

9. The internal combustion engine controller according to claim 7, wherein the torque reduction suppression section inhibits supply of power to at least one external load to suppress the reduction in the torque.

10. The internal combustion engine controller according to claim 1, further comprising a torque reducing section that, when the fuel supply into the remaining cylinder is started, reduces a torque produced by the remaining cylinder, into which the fuel supply is started.

11. The internal combustion engine controller according to claim 1, further comprising a leaning section that, before the fuel supply into the remaining cylinder is started, makes an air-fuel ratio of a mixture that is supplied to the part of the plurality of cylinders leaner than a stoichiometric air-fuel ratio by reducing an amount of fuel supply.

12. The internal combustion engine controller according to claim 1, wherein the starting section always consecutively performs the fuel supply into the cylinder that is next in firing order of the cylinders to the cylinder, in which the fuel supply is performed first.

13. The internal combustion engine controller according to claim 1, further comprising a correction section that corrects a control parameter related to combustion conditions in the cylinder to be fired according to a rotational speed of the internal combustion engine while any one of the remaining cylinders is in an expansion stroke and a degree of decrease in the rotational speed.

14. The internal combustion engine controller according to claim 13, wherein the control parameter includes at least one of a fuel supply amount during a start-up time, a fuel supply amount after the start-up time, a fuel supply timing after the start-up time, and an intake air amount.

15. The internal combustion engine controller according to claim 1, wherein the starting section changes a number of cylinders, into which the fuel supply is performed, according to a magnitude of the negative pressure in the intake piping at a predetermined time point after rotational speed increases due to an initial combustion.

16. The internal combustion engine controller according to claim 1, wherein the starting section performs the fuel supply into the part of the plurality of cylinders, exhaust passages of which have a relatively small surface area between these cylinders to a catalyst, as compared to the at least one remaining cylinder of the plurality of cylinders.

17. An internal combustion engine controller comprising:

a starting section that starts an internal combustion engine by performing fuel supply into part of a plurality of cylinders included in the internal combustion engine; and a fuel supply starting section that starts fuel supply into at least one remaining cylinder of the plurality of cylinders after a magnitude of a negative pressure produced in intake piping of the internal combustion engine exceeds a predetermined reference value;

wherein the starting section performs fuel supply into part of the plurality of cylinders in the internal combustion engine before the magnitude of the negative pressure produced in the intake piping of the internal combustion engine exceeds the predetermined reference value;

wherein the starting section changes a number of cylinders, into which the fuel supply is performed, according to a magnitude of the negative pressure in the intake piping at a predetermined time point after rotational speed increases due to an initial combustion;

wherein the lower the magnitude of the negative pressure in the intake piping at the predetermined time point after the rotational speed increases due to the initial combustion is, the greater number the starting section sets the number of the cylinders, into which the fuel supply is performed when the starting section starts the internal combustion engine, to.

* * * * *